US010036374B2

(12) United States Patent
Lee et al.

(10) Patent No.: US 10,036,374 B2
(45) Date of Patent: Jul. 31, 2018

(54) COMPRESSOR AND METHOD FOR ASSEMBLING A COMPRESSOR

(71) Applicant: LG ELECTRONICS INC., Seoul (KR)

(72) Inventors: Kyeongweon Lee, Seoul (KR); Sunghyun Ki, Seoul (KR); Junghae Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 346 days.

(21) Appl. No.: 14/675,903

(22) Filed: Apr. 1, 2015

(65) Prior Publication Data

US 2016/0003253 A1 Jan. 7, 2016

(30) Foreign Application Priority Data

Jul. 1, 2014 (KR) ..... 10-2014-0081648

(51) Int. Cl.

| | |
|---|---|
| ***F04B 39/00*** | (2006.01) |
| ***F04C 29/06*** | (2006.01) |
| ***F04C 18/02*** | (2006.01) |
| ***F04C 29/00*** | (2006.01) |
| ***F04C 18/356*** | (2006.01) |

(52) U.S. Cl.

CPC ..... *F04B 39/0027* (2013.01); *F04C 18/0207* (2013.01); *F04C 18/0215* (2013.01); *F04C 18/356* (2013.01); *F04C 29/0085* (2013.01); *F04C 29/063* (2013.01);

(Continued)

(58) Field of Classification Search

CPC ..... F04C 29/063; F04B 39/0027; F04B 39/0033; F04B 39/0044

See application file for complete search history.

(56) References Cited

U.S. PATENT DOCUMENTS

| | | | |
|---|---|---|---|
| 2,906,448 | A | 9/1959 | Albert |
| 3,687,224 | A | 8/1972 | Lundin |

(Continued)

FOREIGN PATENT DOCUMENTS

| | | | |
|---|---|---|---|
| CH | 167261 | A | 2/1934 |
| CN | 1626822 | | 6/2005 |

(Continued)

OTHER PUBLICATIONS

Chinese Office Action dated Mar. 3, 2017 issued in Application No. 201510294380.9 (with English translation).

(Continued)

*Primary Examiner* — Kenneth J Hansen

(74) *Attorney, Agent, or Firm* — Ked & Associates LLP

(57) ABSTRACT

A compressor and a method for assembling a compressor are provided. The compressor may include a compressor casing coupled to each of a suction inlet, into which a refrigerant may be introduced, and a discharge outlet, through which the refrigerant may be discharged, a compressor body mounted inside the compressor casing to compress the refrigerant suctioned in through the suction inlet, and then discharge the refrigerant through the discharge outlet, a noise reducing member disposed between the compressor body and the compressor casing, and at least one fixing member mounted inside the compressor casing to fix the noise reducing member to an inner wall of the compressor casing.

10 Claims, 21 Drawing Sheets

(52) U.S. Cl.
CPC ..... *F04C 29/068* (2013.01); *F04C 2230/20* (2013.01); *F04C 2230/60* (2013.01); *F04C 2240/30* (2013.01)

(56) References Cited

U.S. PATENT DOCUMENTS

| | | | | |
|---|---|---|---|---|
| 4,747,761 | A | 5/1988 | Yumiyama et al. | |
| 5,800,150 | A | 9/1998 | Onoda et al. | |
| 6,123,520 | A * | 9/2000 | Moore, Jr. | F01C 21/10 417/410.3 |
| 2005/0175482 | A1 * | 8/2005 | Park | F04B 35/045 417/416 |
| 2011/0300014 | A1 | 12/2011 | Huang et al. | |
| 2013/0115116 | A1 * | 5/2013 | Ki | F04B 35/045 417/321 |
| 2013/0251550 | A1 * | 9/2013 | Cullen, Jr. | F04B 39/0044 417/321 |
| 2014/0161640 | A1 | 6/2014 | Geue et al. | |

FOREIGN PATENT DOCUMENTS

| | | | | |
|---|---|---|---|---|
| CN | 1720395 | | 1/2006 | |
| CN | 201417830 | | 3/2010 | |
| CN | 102112858 | | 6/2011 | |
| CN | 102734161 | | 10/2012 | |
| DE | 3620216 | A1 | 12/1986 | |
| JP | S 58-160572 | | 9/1983 | |
| JP | 2003-120531 | | 4/2003 | |
| JP | 2009-228628 | A | 10/2009 | |
| KR | 10-1307688 | B1 | 9/2013 | |
| WO | WO 2003/044267 | A1 | 5/2003 | |
| WO | WO 2004/057189 | A1 | 7/2004 | |
| WO | WO 2004057189 | A1 * | 7/2004 | F01C 21/104 |
| WO | WO 2009/061038 | A1 | 5/2009 | |

OTHER PUBLICATIONS

European Search Report dated Jan. 22, 2016 issued in Application No. 15165765.7.

* cited by examiner

COMPRESSOR AND METHOD FOR ASSEMBLING A COMPRESSOR

CROSS-REFERENCE TO RELATED APPLICATION(S)

The present application claims priority to Korean Patent Application No. 10-2014-0081648, filed in Korea on Jul. 1, 2014, which is herein incorporated by reference in its entirety.

BACKGROUND

1. Field

A compressor and method for assembling a compressor are disclosed herein.

2. Background

In general, compressors may be mechanisms that receive power from power generation devices, such as electric motors or turbines, to compress air, refrigerants, or other working gases, thereby increasing a pressure of the working gas. Compressors are being widely used in home appliances or industrial machineries, such as refrigerators and air-conditioners.

Compressors may be largely classified into reciprocating compressors, in which a compression space into and from which a working gas is suctioned and discharged, is defined between a piston and a cylinder to allow the piston to be linearly reciprocated in the cylinder, thereby compressing the working gas; rotary compressors in which a compression space, into and from which a working gas may be suctioned or discharged, is defined between a roller that eccentrically rotates and a cylinder to allow the roller to eccentrically rotate along an inner wall of the cylinder, thereby compressing the working gas; and scroll compressors, in which a compression space into and from which a working gas is suctioned or discharged, is defined between an orbiting scroll and a fixed scroll to compress the working gas while the orbiting scroll rotates along the fixed scroll.

A linear compressor according to the related art is disclosed in Korean Patent Registration No. 10-1307688, which is hereby incorporated by reference. The related art linear compressor may suction and compress a refrigerant while a piston is linearly reciprocated in a sealed compressor casing by a linear motor and then discharge the refrigerant. The linear motor may include a permanent magnet disposed between an inner stator and an outer stator. The permanent magnet may be linearly reciprocated by an electromagnetic force between the permanent magnet and the inner (or outer) stator. As the permanent magnet is operated in a state in which the permanent magnet is connected to the piston, refrigerant may be suctioned and compressed while the piston is linearly reciprocated within the cylinder and then, may be discharged.

However, there is a limitation in that such a linear compressor generates noise according to the operation of the compressor. In particular, noise having a middle to high frequency (1 kHz to 4 kHz) may be generated and transmitted outside of the compressor casing of the compressor. Therefore, methods for reducing the noise generated while the compressor operates are required.

BRIEF DESCRIPTION OF THE DRAWINGS

Embodiments will be described in detail with reference to the following drawings in which like reference numerals refer to like elements, and wherein.

DETAILED DESCRIPTION

Embodiments will be described below in more detail with reference to the accompanying drawings. The description is intended to be illustrative, and those with ordinary skill in the technical field will understand that embodiments can be carried out in other specific forms without changing the technical idea or essential features. Also, for helping understanding, the drawings are not to actual scale, but are partially exaggerated in size.

Figure 1:
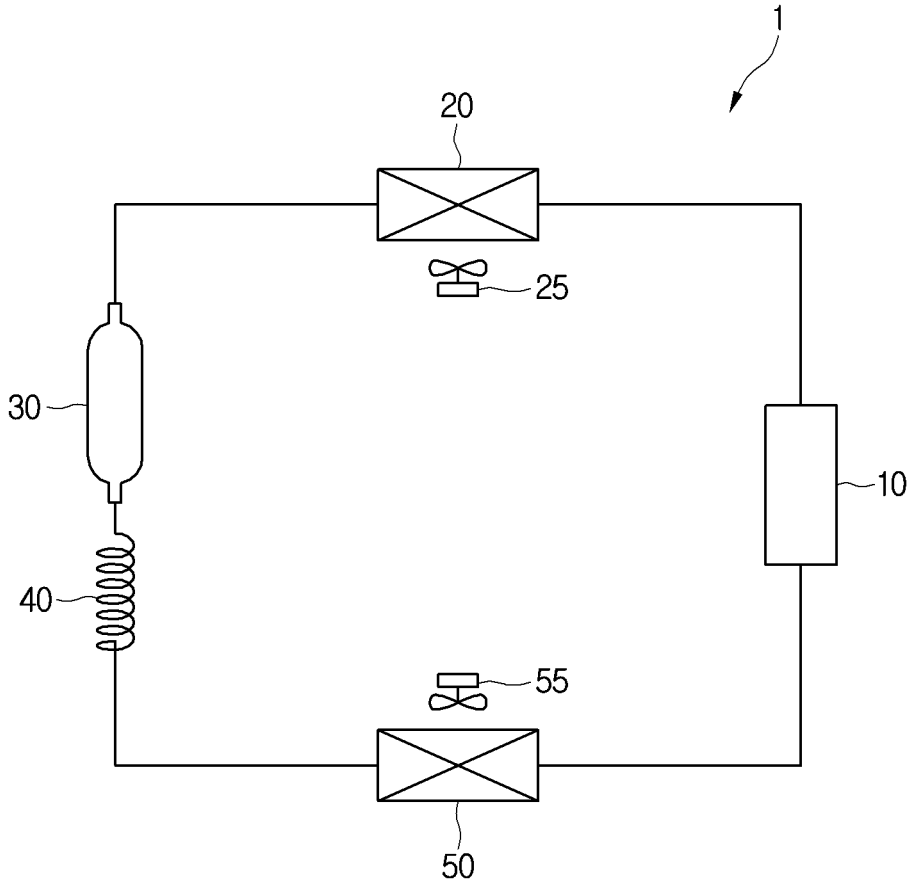
FIG. 1 is a schematic diagram of a refrigerator according to an embodiment.

FIG. 1 is a schematic diagram of a refrigerator according to an embodiment. Referring to FIG. 1, a refrigerator 1 according to an embodiment may include a plurality of devices to drive a refrigeration cycle.

In detail, the refrigerator may include a compressor 10 to compress a refrigerant, a condenser 20 to condense the refrigerant compressed in the compressor 10, a dryer 30 to remove moisture, foreign substances, or oil from the refrigerant condensed in the condenser 20, an expansion device 40 to decompress the refrigerant passing through the dryer 30, and an evaporator 50 to evaporate the refrigerant decompressed in the expansion device 40. The refrigerator 1 may further include a condensation fan 25 to blow air toward the condenser 20, and an evaporation fan 55 to blow air toward the evaporator 50.

The compressor 10 may be a reciprocating compressor, a rotary compressor, or a scroll compressor, for example. Such a compressor will be described with reference to the drawings in detail.

The expansion device 40 may include a capillary tube having a relatively small diameter. A liquid refrigerant condensed in the condenser 20 may be introduced into the dryer 30. A gaseous refrigerant may be partially contained in the liquid refrigerant. A filter to filter the liquid refrigerant introduced into the dryer 30 may be provided in the dryer 30.

Hereinafter, the compressor 10 according to an embodiment will be described in detail.

Figure 2:
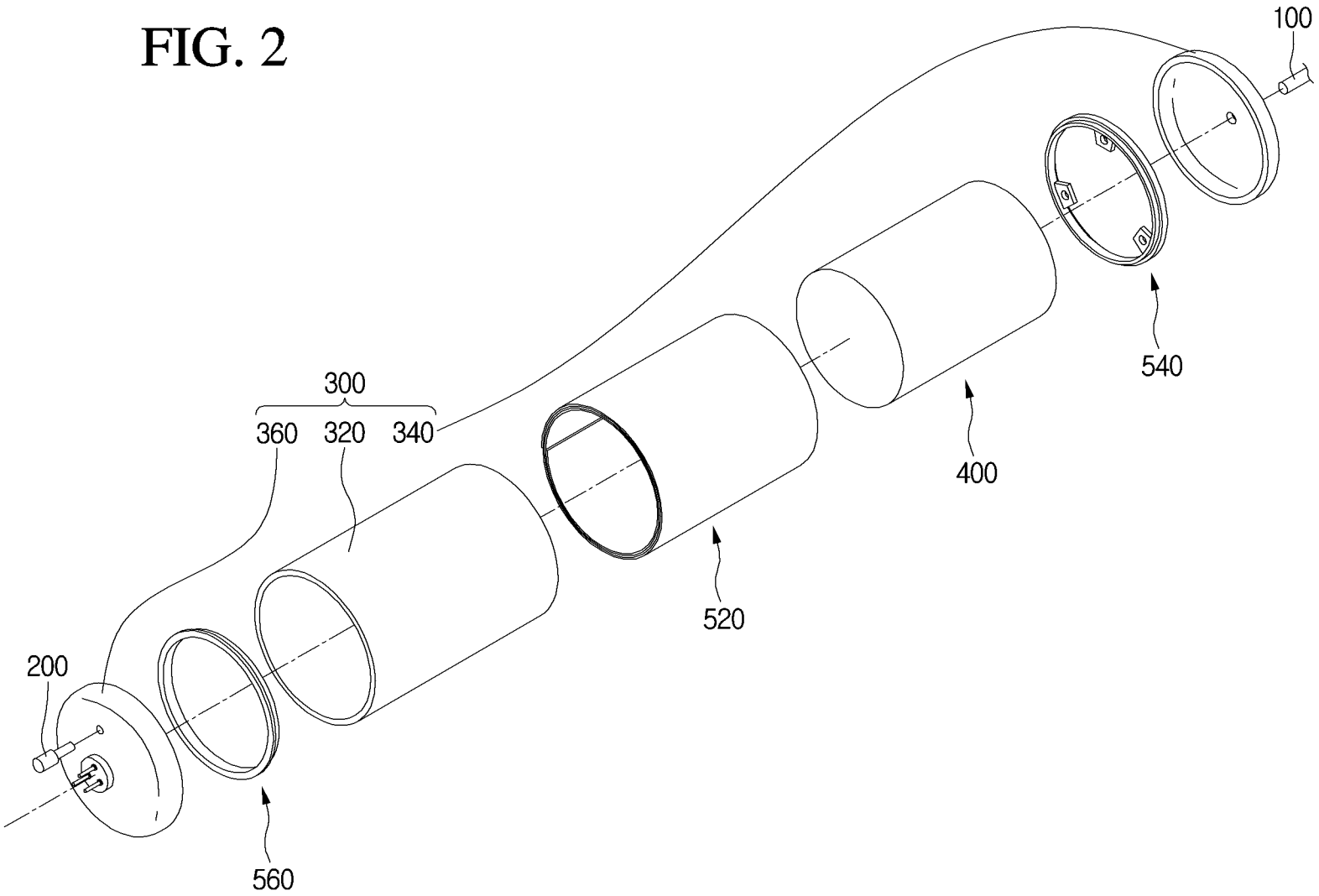
FIG. 2 is an exploded perspective view of a compressor of the refrigerator of FIG. 1.
Figure 3:
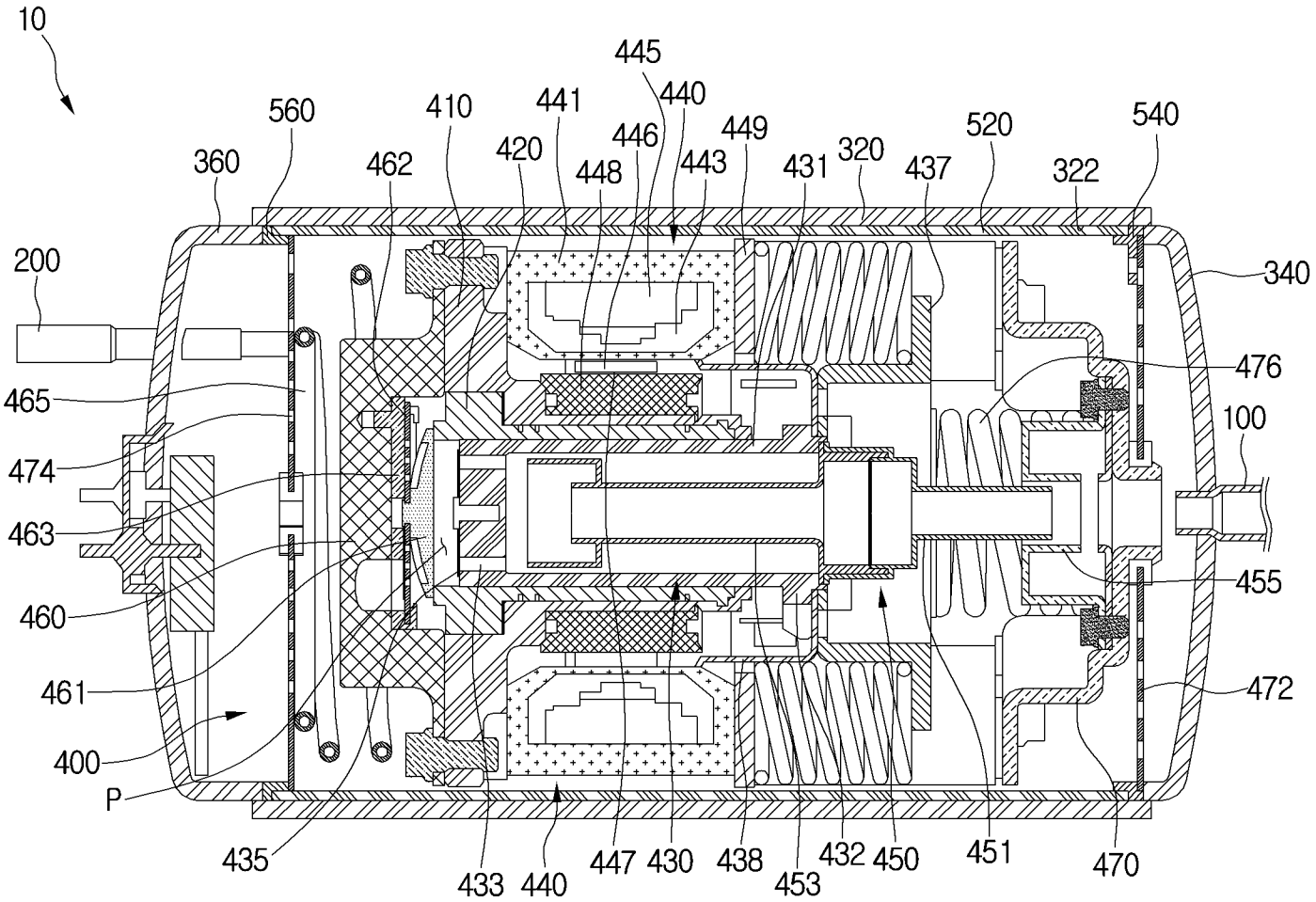
FIG. 3 is a cross-sectional view of the compressor of FIG. 2.
Figure 4:
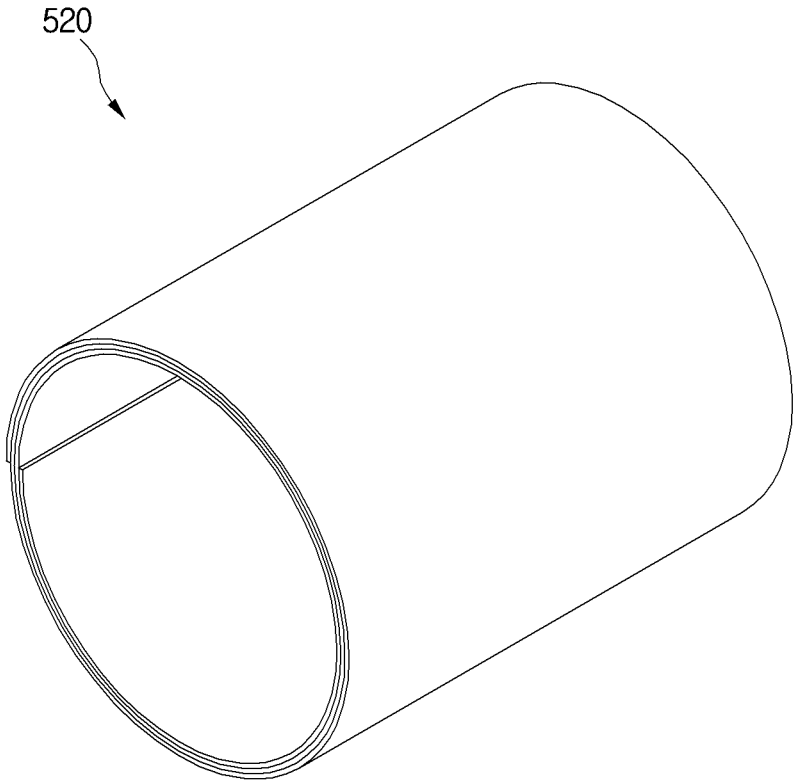
FIG. 4 is a perspective view of a noise reducing member of the compressor of FIG. 2.
Figure 5:
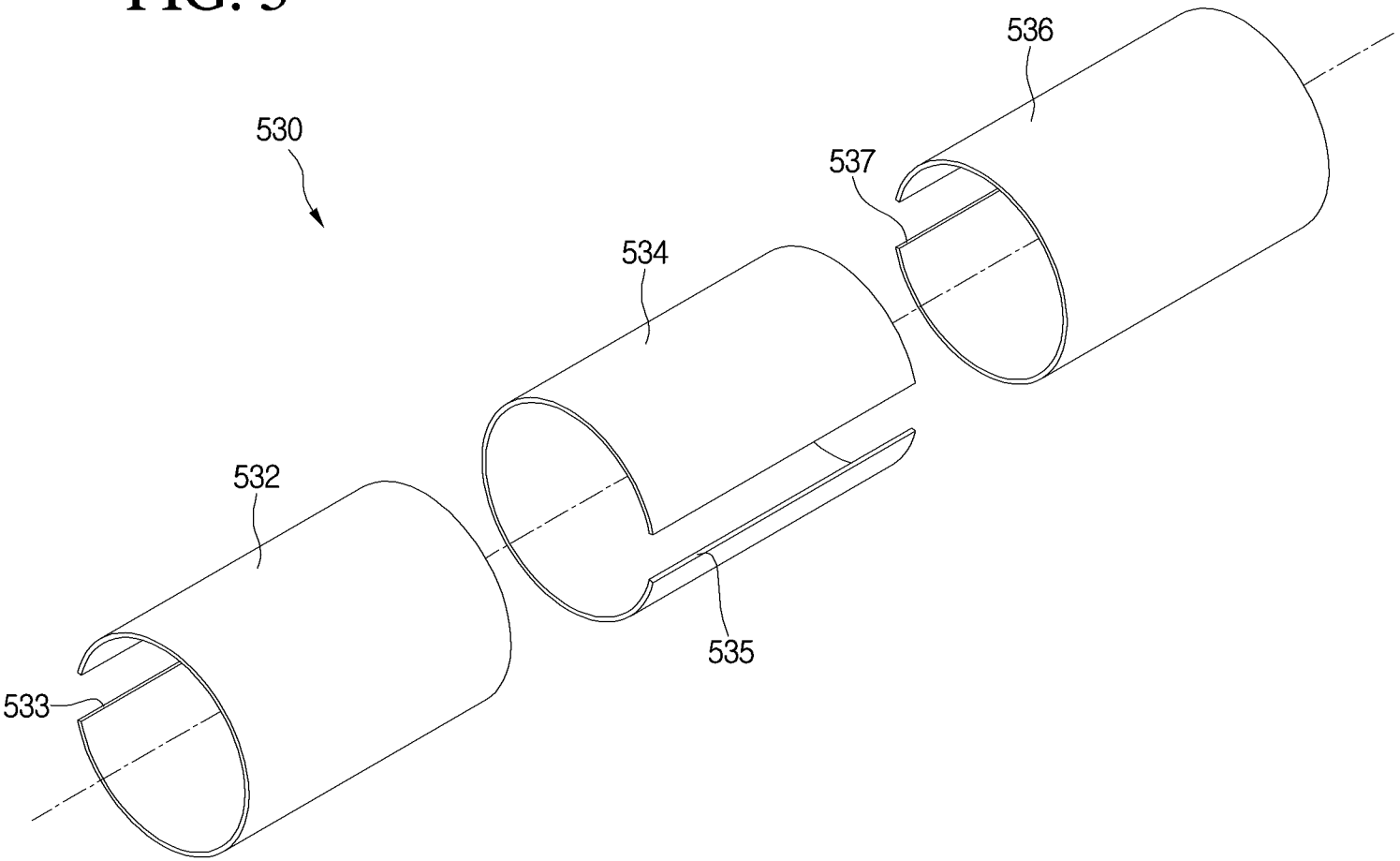
FIG. 5 is an exploded perspective view of a noise reducing member according to another embodiment.
Figure 6:
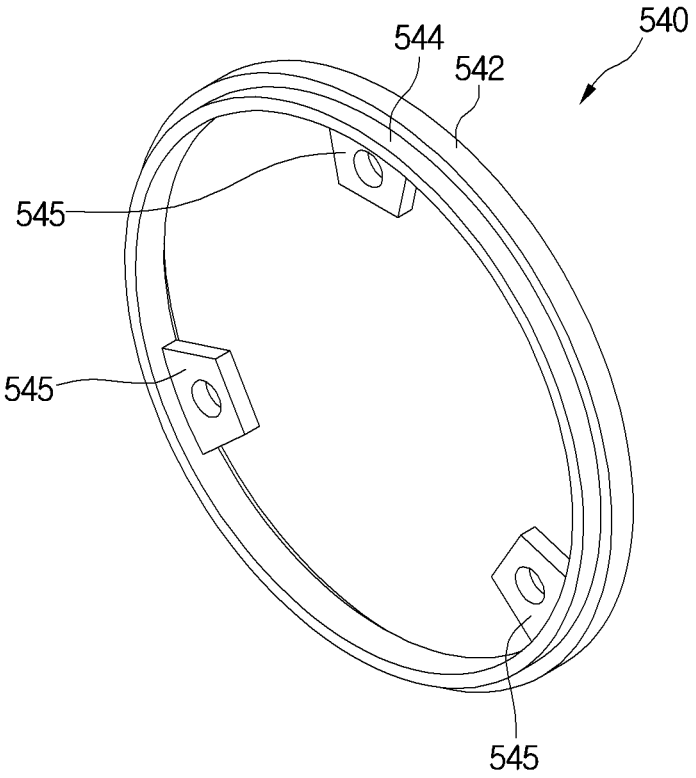
FIG. 6 is a perspective view of a first fixing member of the compressor of FIG. 2.
Figure 7:
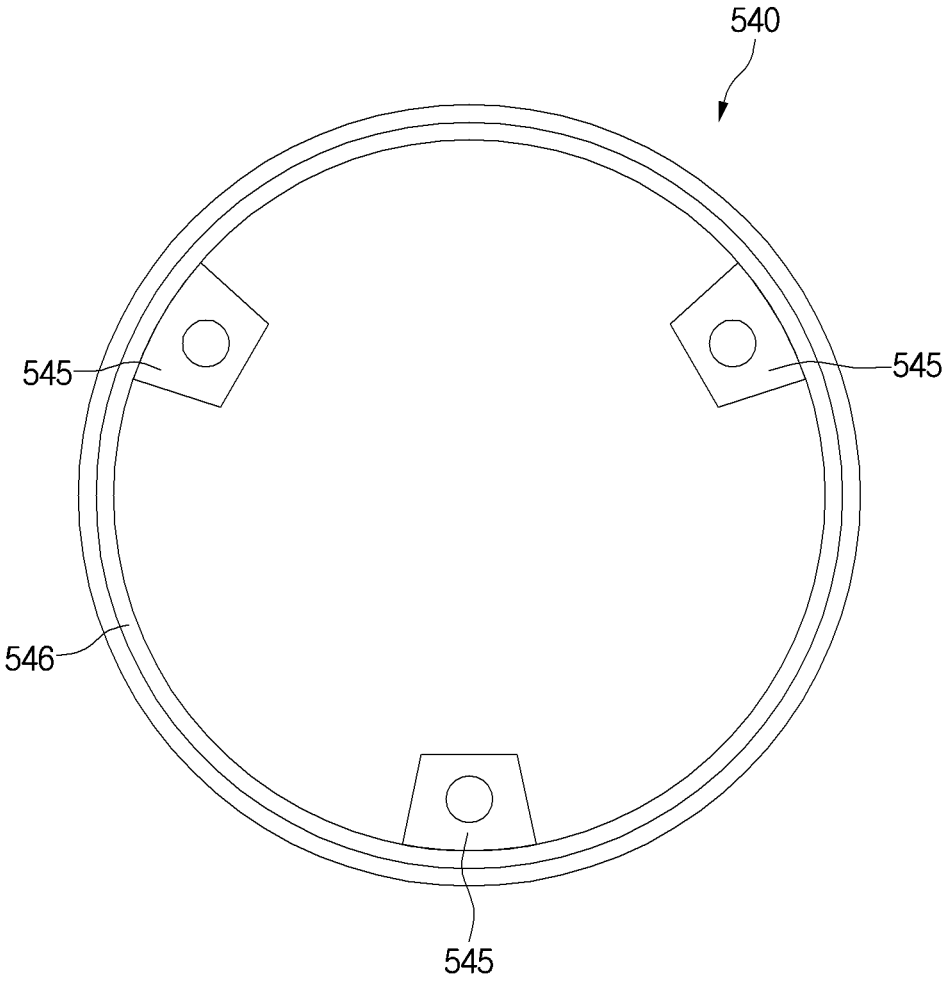
FIG. 7 is a rear view of the first fixing member of FIG. 6.
Figure 8:
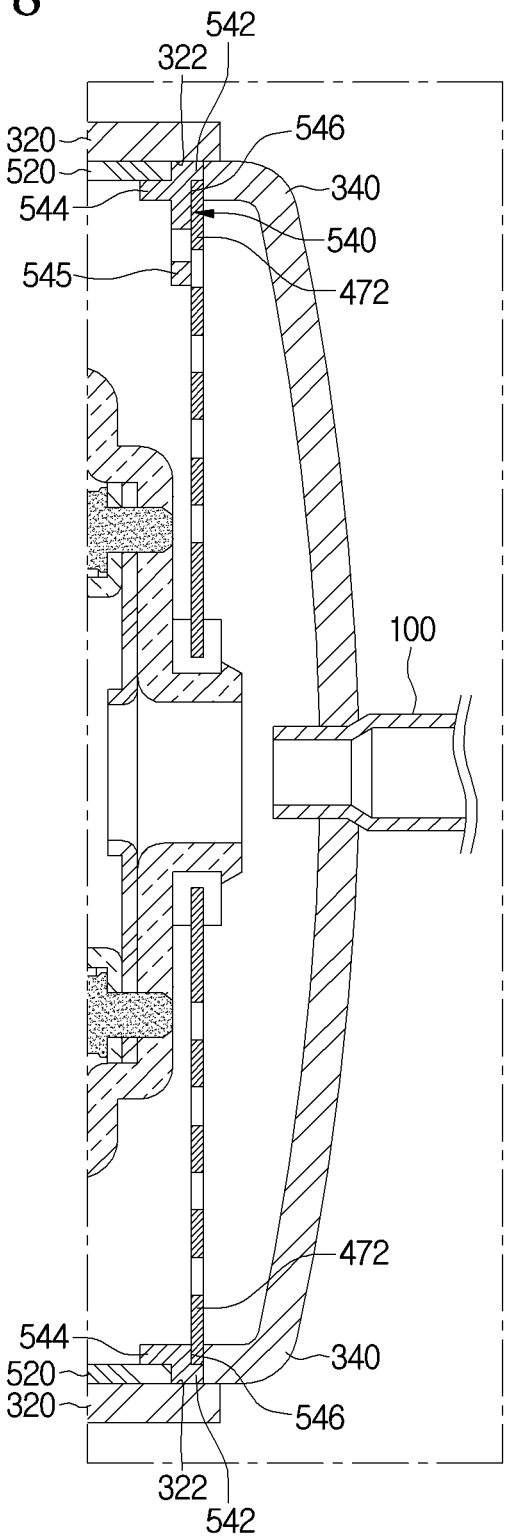
FIG. 8 is a view illustrating a state in which the noise reducing ember is fixed using the first fixing member.
Figure 9:
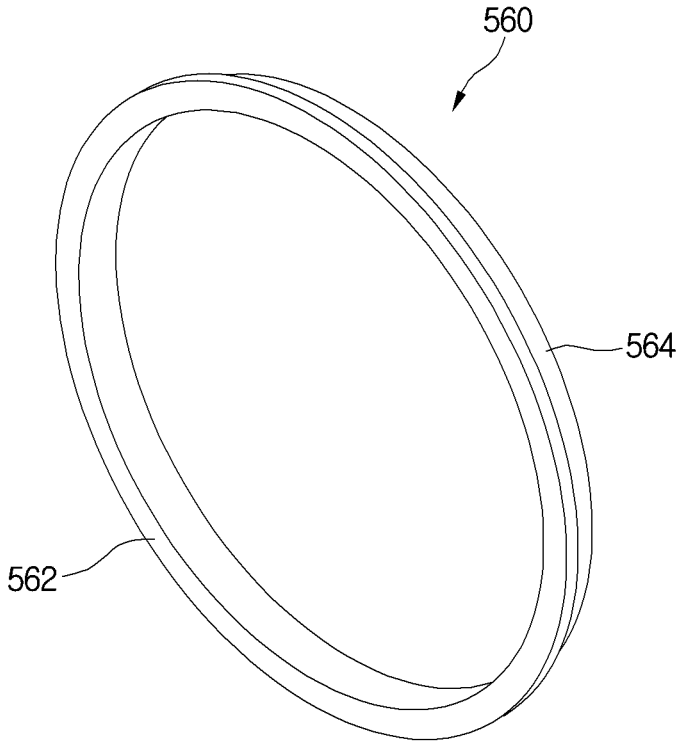
FIG. 9 is a perspective view of a second fixing member of the compressor of FIG. 2.
Figure 10:
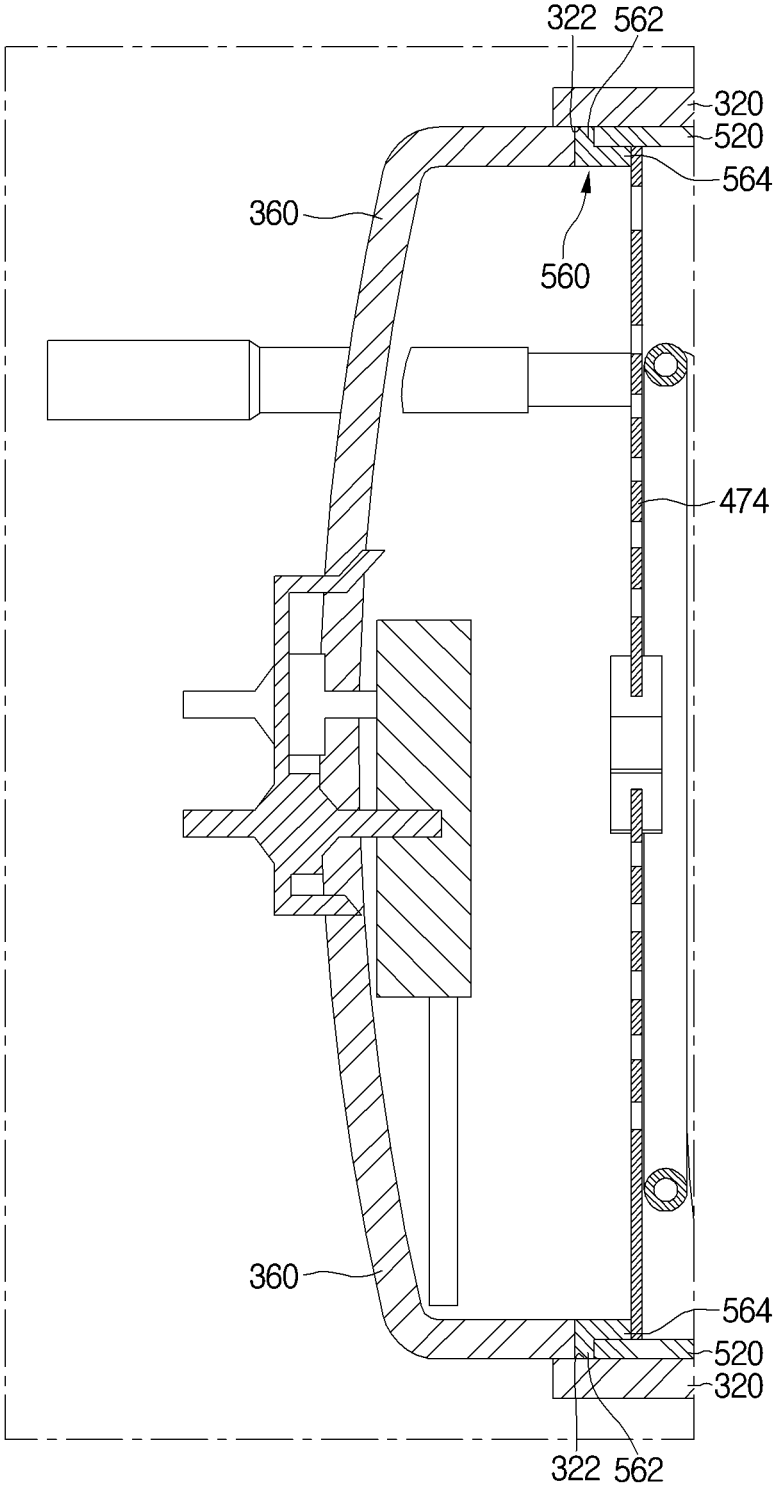
FIG. 10 is a view illustrating a state in which the noise reducing member is fixed using the second fixing member of FIG. 9.

FIG. 2 is an exploded perspective view of a compressor of the refrigerator of FIG. 1. FIG. 3 is a cross-sectional view of the compressor of FIG. 2. FIG. 4 is a perspective view of a noise reducing member of the compressor of FIG. 2. FIG. 5 is an exploded perspective view of a noise reducing member according to another embodiment FIG. 6 is a perspective view of a first fixing member of the compressor of FIG. 2. FIG. 7 is a rear view of the first fixing member of FIG. 6. FIG. 8 is a view illustrating a state in which the noise reducing member is fixed using the first fixing member. FIG. 9 is a perspective view of a second fixing member of the compressor of FIG. 2. FIG. 10 is a view illustrating a state in which the noise reducing member is fixed using the second fixing member of FIG. 9.

Referring to FIGS. 2 to 10, the compressor 10 may be a reciprocating compressor, in which a compression space defined between a piston and a cylinder to allow a working gas, such as a refrigerant, to be suctioned into and discharged from the compression space to compress the working gas while the piston is linearly reciprocated within the cylinder, that is, a linear compressor. The linear compressor 10 may include a suction inlet 100, a discharge outlet 200, a compressor casing 300, compressor body 400, a noise reducing member 520, a first fixing member 540, and a second fixing member 560.

The suction inlet 100 may introduce the refrigerant into the compressor body 400 and may pass through a first cover 340 of the compressor casing 300, which will be described hereinbelow. The discharge outlet 200 may discharge the compressed refrigerant from the compressor body 400 and may pass through a second cover 360 of the compressor casing 300, which will be described hereinbelow.

The compressor casing 300 may accommodate the compressor body 400 and includes a base shell 320, the first cover 340, and the second cover 360. The base shell 320 may accommodate the compressor body 400 therein. The base shell 320 may have an approximately cylindrical shape. The base, shell 320 may define the exterior of the linear compressor 10 particularly, a lateral exterior of the linear compressor 10. The base shell 320 may have a thickness of about 2 T.

The first cover 340 may be mounted on a side or end of the base shell 320. In this embodiment, the first cover 114 may be mounted on a first side or end of the base shell 320. The suction inlet 100 may passes through the first cover 340 to introduce the refrigerant into the compressor body 400.

The second cover 360 may be mounted on another side or end of the base shell 320. In this embodiment, the second cover 360 is mounted on a second side or end of the base shell 320, which is opposite to the first cover 340. The discharge outlet 200 may pass through the second cover 360 to discharge the compressed refrigerant.

The compressor body 400 may compress the refrigerant introduced through the suction inlet 100 and discharge the compressed refrigerant through the discharge outlet 200. The compressor body 400 may include a cylinder 420 provided in the base shell 320, a piston 430 linearly reciprocated within the cylinder 420, and a motor assembly 440, which may be a linear motor that applies a drive force to the piston 430.

The compressor body 400 may further include a suction muffler 450. The refrigerant suctioned in through the suction inlet 100 may flow into the piston 430 via the suction muffler 450. While the refrigerant passes through the suction muffler 450, noise may be reduced. The suction muffler 450 may be configured by coupling a first muffler 451 to a second muffler 453. At least a portion of the suction muffler 450 may be disposed within the piston 430.

The piston 430 may include a piston body 431 having an approximately cylindrical shape, and a piston flange 432 that extends from the piston body 431 in a radial direction. The piston body 431 may be reciprocated within the cylinder 420, and the piston flange 432 may be reciprocated outside of the cylinder 420.

The piston 430 may be formed of a nonmagnetic material, such as an aluminum material, such as aluminum or an aluminum alloy. As the piston 430 may be formed of the aluminum material, a magnetic flux generated in the motor assembly 440 may not be transmitted into the piston 430, and thus, may be prevented from leaking outside of the piston 430. The piston 430 may be manufactured by, for example, a forging process.

The cylinder 420 may be formed of a nonmagnetic material, such as an aluminum material, such as aluminum or an aluminum alloy. The cylinder 420 and the piston 430 may have a same material composition, that is, a same kind and composition.

As the cylinder 420 may be formed of the aluminum material, the magnetic flux generated in the motor assembly 440 may not be transmitted into the cylinder 420 and thus, may be prevented from leaking outside of the cylinder 420. The cylinder 420 may be manufactured by, for example, an extruding rod processing process.

As the piston 430 may be formed of the same, material, for example, aluminum as the cylinder 420, the piston 430 may have a same thermal expansion coefficient as the cylinder 420. When the linear compressor 10 operates, a high-temperature (a temperature of about 100° C.) environment may be created within the compressor casing 300. Thus, as the piston 430 and the cylinder 420 may have the same thermal expansion coefficient, the piston 430 and the cylinder 420 may be thermally deformed by a same degree. As a result, the piston 430 and the cylinder 420 may be thermally deformed with sizes and in directions different from each other to prevent the piston 430 from interfering with the cylinder 420 while the piston 430 moves.

The cylinder 420 may be configured to accommodate at least a portion of the suction muffler 450 and at least a portion of the piston 430. The cylinder 420 may have a compression space P, in which the refrigerant may be compressed by the piston 430. A suction hole 433, through which the refrigerant may be introduced into the compression space P, may be defined in a front portion of the piston 430, and a suction valve 435 to selectively open the suction hole 433 may be disposed on or at a front side of the suction hole 433. A coupling hole, to which a predetermined coupling member may be coupled, may be defined in an approximately central portion of the suction valve 435.

A discharge cover 460 that defines a discharge space or discharge passage for the refrigerant discharged from the compression space P and a discharge valve assembly 461, 462, and 463 coupled to the discharge cover 460 to selectively discharge the refrigerant compressed in the compression space P may be provided at a front side of the compression space P. The discharge valve assembly 461, 462, and 463 may include a discharge valve 461 to introduce the refrigerant into the discharge space of the discharge cover 460 when e pressure within the compression space P is above a predetermined discharge pressure, a valve spring 462 disposed between the discharge valve 461 and the discharge cover 460 to apply an elastic force in an axial direction, and a stopper 463 to restrict deformation of the valve spring 462.

The compression space P may refer to a space defined between the suction valve 435 and the discharge valve 461. The term "axial direction" may refer to a direction in which the piston 530 is reciprocated. The term "radial direction"

may refer to a direction perpendicular to the direction in which the piston 430 is reciprocated, that is, a horizontal direction in FIG. 2.

The stopper 463 may be seated on the discharge cover 460, and the valve spring 462 may be seated at a rear side of the stopper 463. The discharge valve 461 may be coupled to the valve spring 462, and a rear portion or rear surface of the discharge valve 461 may be supported by a front surface of the cylinder 420. The valve spring 462 may include a plate spring, for example.

The suction valve 435 may be disposed on or at a first side of the compression space P, and the discharge valve 461 may be disposed on or at a second side of the compression space P, that is, a side opposite of the suction valve 435. While the piston 430 is linearly reciprocated within the cylinder 420, when the pressure of the compression space P is below the predetermined discharge pressure and predetermined suction pressure, the suction valve 435 may be opened to suction die refrigerant into the compression space P. On the other hand, when the pressure of the compression space P is above the predetermined suction pressure, the suction valve 435 may compress the refrigerant of the compression space P in a state in which the suction valve 435 is closed. When the pressure of the compression space P is above the predetermined discharge pressure, the valve spring 462 may be deformed to open the discharge valve 461. The refrigerant may be discharged from the compression space P into the discharge space of the discharge cover 460.

The refrigerant flowing into the discharge space of the discharge cover 460 may be introduced into a loop pipe 465. The loop pipe 465 may be coupled to the discharge cover 460 to extend to the discharge outlet 200, thereby guiding the compressed refrigerant in the discharge space into the discharge outlet 200. For example, the loop pipe 465 may have a shape which is wound in a predetermined direction and extends in a rounded shape. The loop pipe 465 may be coupled to the discharge outlet 200.

The compressor body 400 may further include a frame 410. The frame 410 may fix the cylinder 420 and be coupled to the cylinder 420 by a separate coupling member, for example. The frame 410 may be disposed to surround the cylinder 420. That is, the cylinder 420 may be accommodated within the frame 410. The discharge cover 460 may be coupled to a front surface of the frame 410.

At least a portion of the high-pressure gaseous refrigerant discharged through the opened discharge valve 461 may flow toward an outer circumferential surface of the cylinder 420 through a space formed at a portion at which the cylinder 420 and the frame 410 are coupled to each other.

The refrigerant may be introduced into the cylinder 420 through a gas inflow and a nozzle, which may be defined in the cylinder 420. The introduced refrigerant may flow into a space defined between the piston 430 and the cylinder 420 to allow an outer circumferential surface of the piston 430 to be spaced apart from an inner circumferential surface of the cylinder 420. Thus, the introduced refrigerant may serve as a "gas bearing" that reduces friction between the piston 430 and the cylinder 420 while the piston 430 is reciprocated.

The motor assembly 440 may include outer stators 441, 443, and 445 fixed to the frame 410 and disposed to surround the cylinder 420, an inner stator 448 disposed to be spaced inward from the outer stators 441, 443, and 445, and a permanent magnet 446 disposed in a space between the outer stators 441, 443, and 445 and the inner stator 148. The permanent magnet 446 may be linearly reciprocated by a mutual electromagnetic force between the outer stators 441, 443, and 445 and the inner stator 448. The permanent magnet 446 may be provided as a single magnet having one polarity, or may include a plurality of magnets having three polarities.

The permanent magnet 446 may be coupled to the piston 430 by a connection member 438, for example. In detail, the connection member 438 may be coupled to the piston flange 432 and be bent, to extend toward the permanent 446. As the permanent magnet 446 is reciprocated, the piston 430 may be reciprocated together with the permanent magnet 448 in the axial direction.

The motor assembly 440 may further include a fixing member 447 to fix the permanent magnet 446 to the connection member 438. The fixing member 447 may be formed of a composition in which a glass fiber or carbon fiber is mixed with a resin. The fixing member 447 may surround an outside of the permanent magnet 446 to firmly maintain a coupled state between the permanent magnet 446 and, the connection member 438.

The outer stators 441, 443, and 445 may include coil winding bodies 443 and 445, and a stator pore 441. The coil winding bodies 443 and 445 may include a bobbin 443 and a coil 445 wound in a circumferential direction of the bobbin 443. The coil 445 may have a polygonal cross-section, for example, a hexagonal cross-section. The stator core 441 may be manufactured by stacking a plurality of laminations in the circumferential direction and be disposed to surround the coil winding bodies 443 and 445.

A stator cover 449 may be disposed at one side of the outer stators 441, 443, and 445. A first side of the outer stators 441, 443, and 445 may be supported by the frame 410, and a second side of the outer stators 441, 443, and 445 may be supported by the stator cover 449. The inner stator 448 may be fixed to a circumference of the cylinder 420. Also, in the inner stator 448, a plurality of laminations may be stacked in a circumferential direction outside the cylinder 420.

The compressor body 400 may further include a support 437 to support the piston 430, and a back cover 470 spring-coupled to the support 437. The support 437 may be coupled to the piston flange 432 and the connection member 438 by a predetermined coupling member, for example.

A suction guide 455 may be coupled to a front portion of the back cover 470. The suction guide 455 may guide the refrigerant, suctioned through the suction inlet 100 to introduce the refrigerant into the suction muffler 450.

The compressor body 400 may include a plurality of springs 476 which may be adjustable in natural frequency to allow the piston 430 to perform a resonant motion. The plurality of springs 476 may include a first spring (not shown) supported between the support 437 and the stator cover 449 and a second spring supported between the support 437 and the back cover 470.

The compressor body 400 may additionally include a pair of plate springs 472 and 474 to support the compressor body 400 by the base shell 320. The pair of plate springs 472 and 474 may includes a first plate spring 472 and a second plate spring 474.

The first plate spring 472 may be mounted on the first fixing member 540, which will be described hereinbelow, and the second plate spring 474 may be mounted on the second plate spring 474, which will be described hereinbelow. However, the first and second plate springs 472 and 474 are not limited to mounting positions thereof. For example, if the compressor body 400 is supported by the base shell 320, the first and second plate springs 472 and 474 may be coupled to the first and second covers 340 and 360.

The noise reducing member 520 may surround an inner wall 322 of the base shell 320. In this embodiment, as the noise reducing member 520 is mounted on an inner side of the base shell 320, the base shell 320 may substantially increase in thickness. Thus, while the compressor body 400 operates, noise generated from the compressor body 400 may not be heard outside of the compressor casing 300.

The noise reducing member 520 may be formed of a steel plate having a thickness of about 0.4 T to about 1.0 T. The noise reducing member 520 may have a cylindrical shape, which may be roiled at least once. For this, the noise reducing member 520 may be formed of spring steel (SK5) having strong elasticity, or steel (SA1010) having strong elasticity among general steel so as to smoothly perform rolling.

As illustrated in FIG. 4, the noise reducing member 520 may be formed by rolling one steel plate several times so that the noise reducing member 520 has a rolled cylindrical shape. For example the noise reducing member 520 may be formed by rolling the steel plate at least one to ten times.

Alternatively, illustrated in FIG. 5, the noise reducing member 530 may be formed by overlapping a plurality of cylindrical portions 532, 534, and 536. Each of the cylindrical portions 532, 534, and 536 may be formed of steel having strong elasticity similar to the noise reducing member 530. Slits 533, 535, and 537 may be defined in side surfaces of the cylindrical portions 532, 534, and 536, respectively. Each of the slits 533, 535, and 537 may be defined when the steel plate having strong elasticity is rolled during a process of manufacturing each of the cylindrical portions 532, 534, and 536. The cylindrical portions 532, 534, and 536 may smoothly overlap each other due to the slits 533, 535, and 537. As described above, the noise reducing member 530 may be formed by overlapping the plurality of cylindrical portions 532, 534, and 536. Hereinafter, this embodiment will be limited to the noise reducing member 520 having a thickness of about 0.4 T and rolled three times.

Referring to FIG. 6, the first fixing r ember 540 may include a fixing portion 542, a protrusion 544, at least one spring mount 545, and a spring support 546. The fixing portion 542 may have a ring shape. One or a first end of the fixing portion 542 may be fixed to the inner wall 322 of the base shell 320.

The protrusion 544 may extend from the other or a second end of the fixing portion 542 so that the protrusion 544 has a predetermined thickness in a direction perpendicular to a radial direction of the fixing portion 542 to allow the noise reducing member 520 to be inserted into the first fixing member 540.

Each at least one spring mount 545 may extend in a radial direction of the protrusion 544. The at least one spring mount 545 may include a plurality of spring mounts 545. In this embodiment, three spring mounts 545 are shown; however, embodiments are not limited thereto. Each of the spring mounts 545 may be coupled to the first plate spring 472 through a coupling member, such as a bolt, for example.

The spring support 546 may be disposed on a rear surface of the protrusion 544 to support the first plate spring 545. The spring support 546 may be disposed in a same line as the plurality of spring mounts 545.

Thus, the first fixing member 540 may fix one or a first end of the noise reducing member 520 to the inner wall 322 of the base shell 320 and be coupled to the first cover 340. Also, the first fixing member 540 may stably support the first plate spring 472.

The second fixing member 560 may include a fixing portion 562 and a protrusion 564. One or a first end of the fixing portion 562 may be fixed to the inner wall 322 of the base shell 320 similar to the fixing portion 542 of the first fixing member 540.

The protrusion 562 may extend from the other or a second end of the fixing portion 562 so that the protrusion 562 has a predetermined thickness in a direction perpendicular to a radial direction of the fixing portion 562 to allow the noise reducing member 520 to be inserted into the second fixing member 560.

Thus, the second fixing member 560 may fix the other or a second end of the noise reducing member 520 to the inner wall 322 of the base shell 320 and be coupled to the second cover 360. Also, the above-described second plate spring 474 may be mounted on the second fixing member 560. Although not shown, a spring mount and a spring support may be disposed on the second fixing member 560 similar to those of the first fixing member 540. If the second fixing member 560 has structure for stably supporting the plate spring 474, the plate spring mount 545 and the spring support 546 may be omitted.

According to this embodiment, the noise reducing member 520 to prevent noise generated while the linear compressor 10 operates may be stably mounted on the compressor casing 300 using the first and second fixing r embers'540 and 560.

Hereinafter, a method for assembling the linear compressor 10 including the noise reducing member 520 according to an embodiment will be described in detail.

Figure 11:
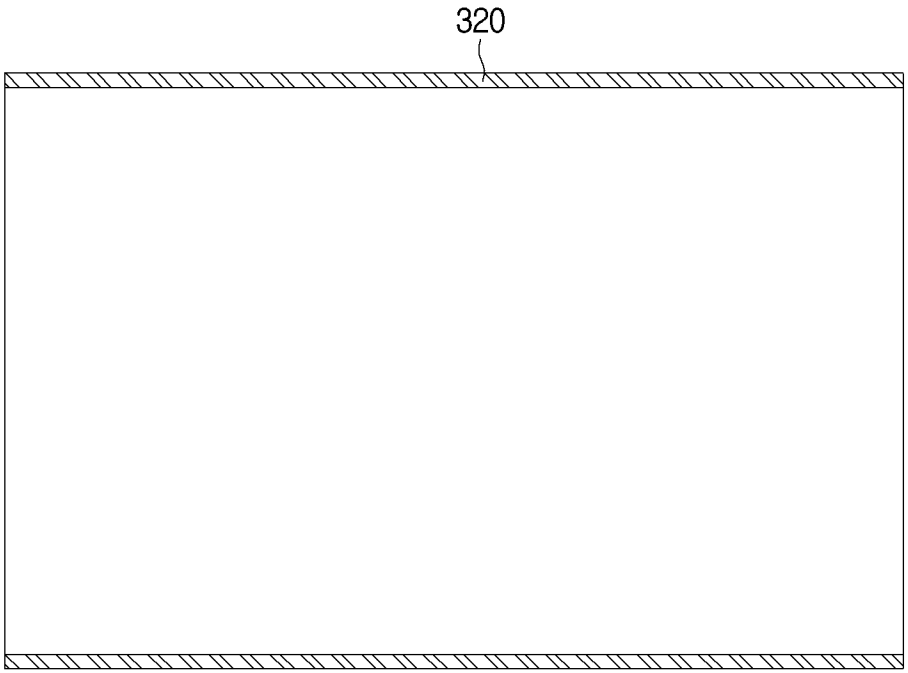
FIGS. 11 to 19 are views illustrating a method for assembling the compressor of FIG. 2.
Figure 12:
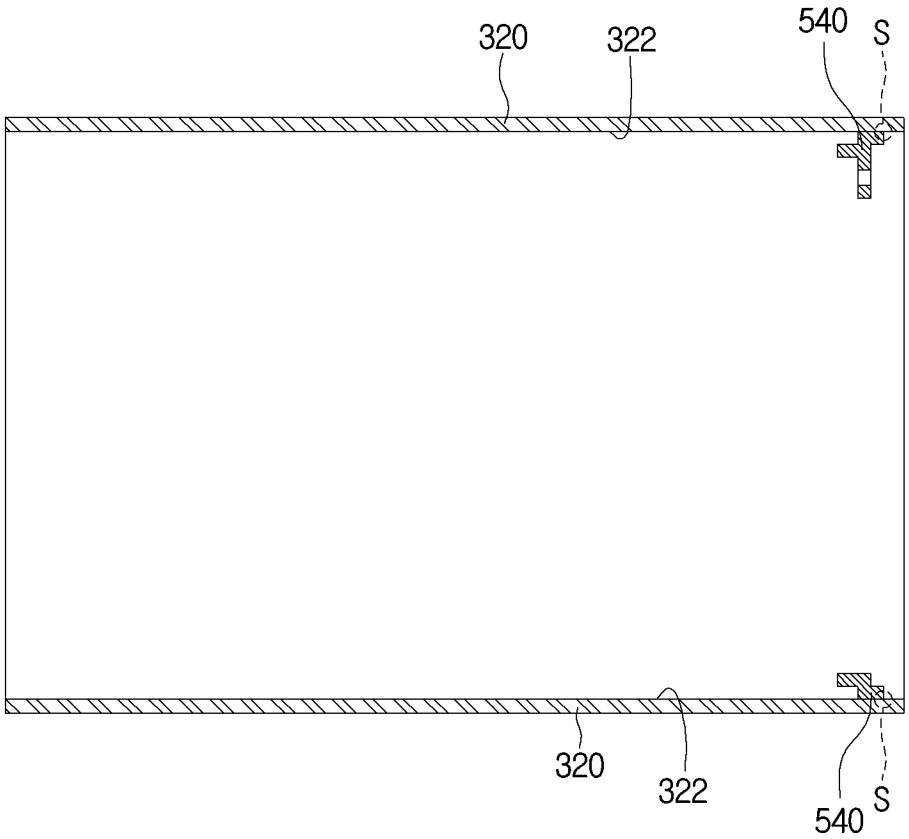

FIGS. 11 to 19 are views illustrating a method for assembling the compressor of FIG. 2. Referring to FIGS. 11 and 12, the first fixing member 540 may be mounted on the first side of the inner wall 322 of the base shell 320. The first fixing member 540 may be fixed in the base shell 320 by, for example, a welding process S. However, this embodiment is not limited to the welding process S, that is, other processes to fix the first fixing member 540 into the base shell 320 may be applied.

Figure 13:
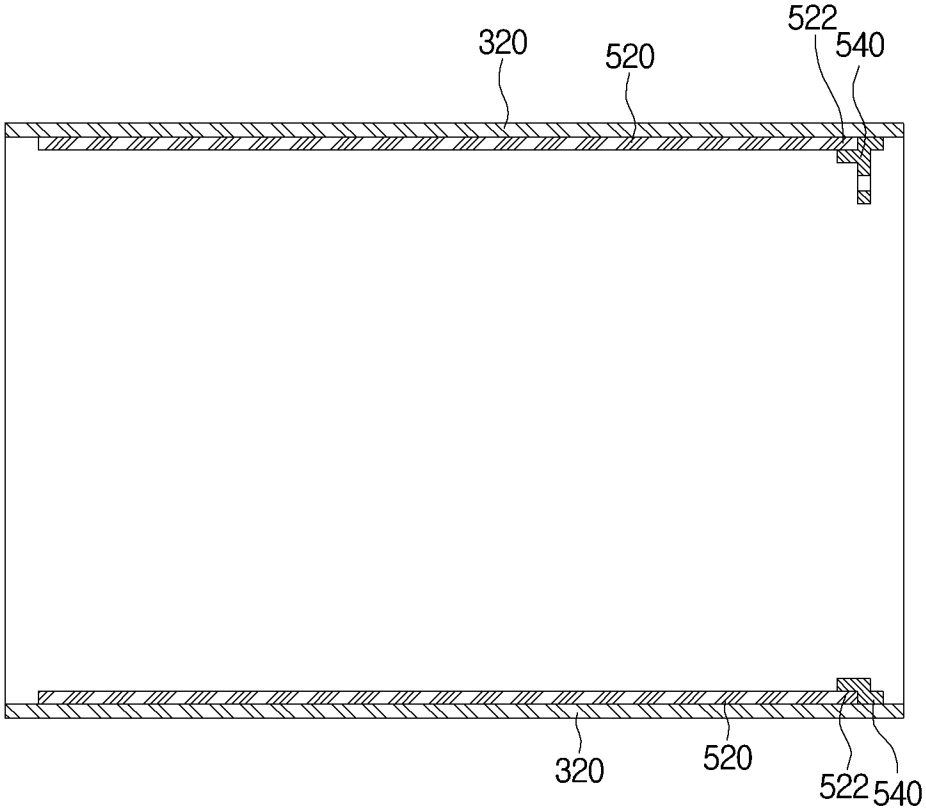

Referring to FIG. 13, the noise reducing member 520 may be mounted to surround the inner wall 322 of the base shell 320. The second end 522 of the noise reducing member 520 may be inserted into the first fixing member 540.

Figure 14:
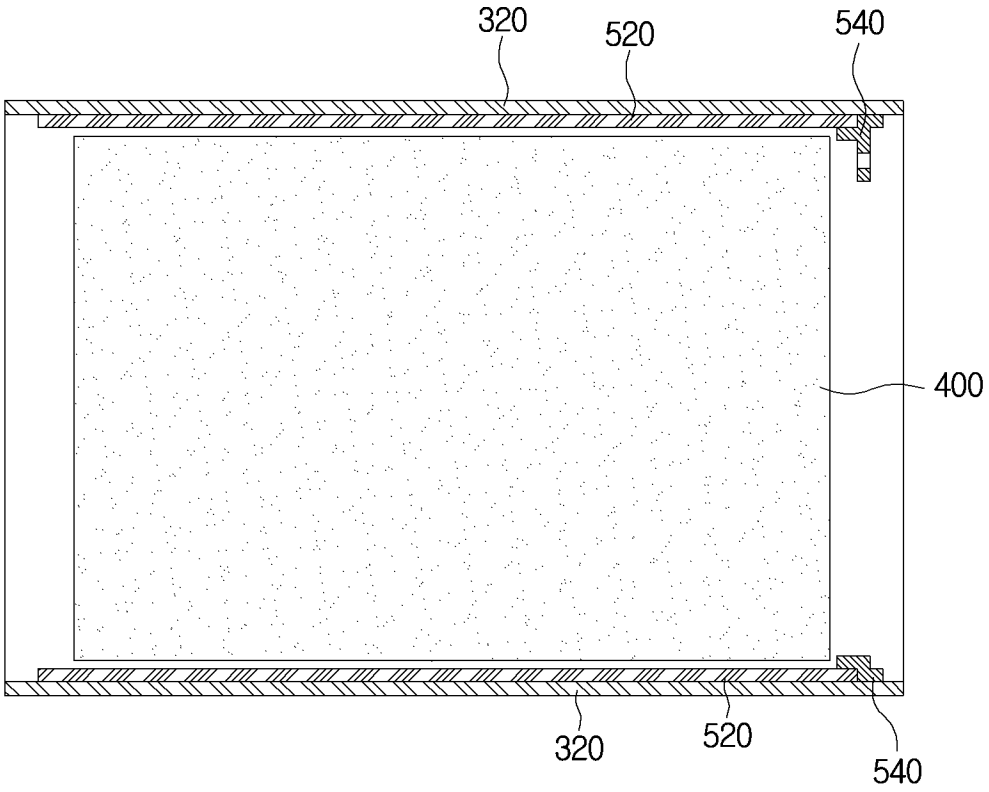

Referring to FIG. 14, the compressor body 400 may be mounted inside the base shell 320. For convenience of the explanation, the compressor body 400 will be simplified in the following drawings. As described above, the first plate spring (see reference numeral 472 of FIG. 3) of the compressor body 400 may be mounted on the first fixing member 540.

Figure 15:
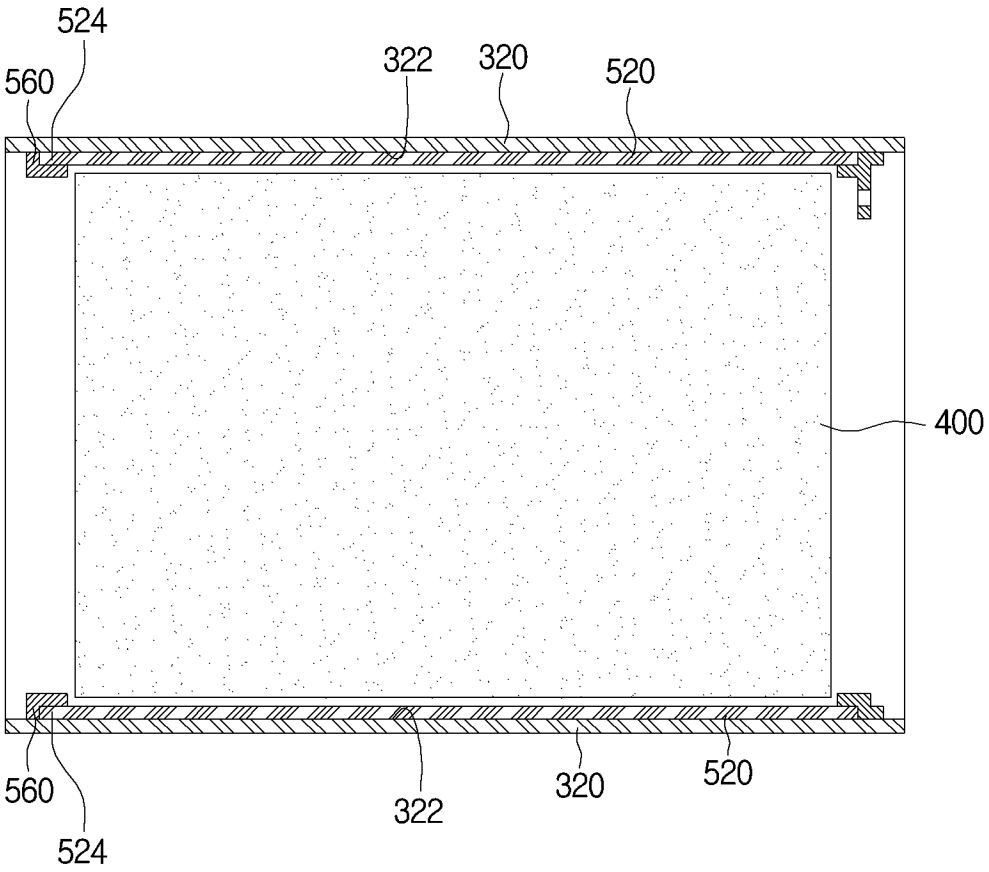

Referring to FIG. 15, after the compressor body 400 is mounted on the inside of the base shell 320, the second fixing member 560 may be mounted inside the base shell 320. The second fixing member 560 may be mounted on the second side of the inner wall 322 of the base shell 320 so that the second end 524 of the noise reducing member 520 may be inserted thereto. The second fixing member 560 may be fixed into the base shell 320 by, for example a press-fit process. However, this embodiment is not limited to the fitting process, that is, other processes to fix the second fixing member 560 into the base shell 320 may be applied. As described above, the second plate spring (see reference numeral 474 of FIG. 3) of the compressor body 400 may be mounted on the second fixing member 560.

Figure 16:
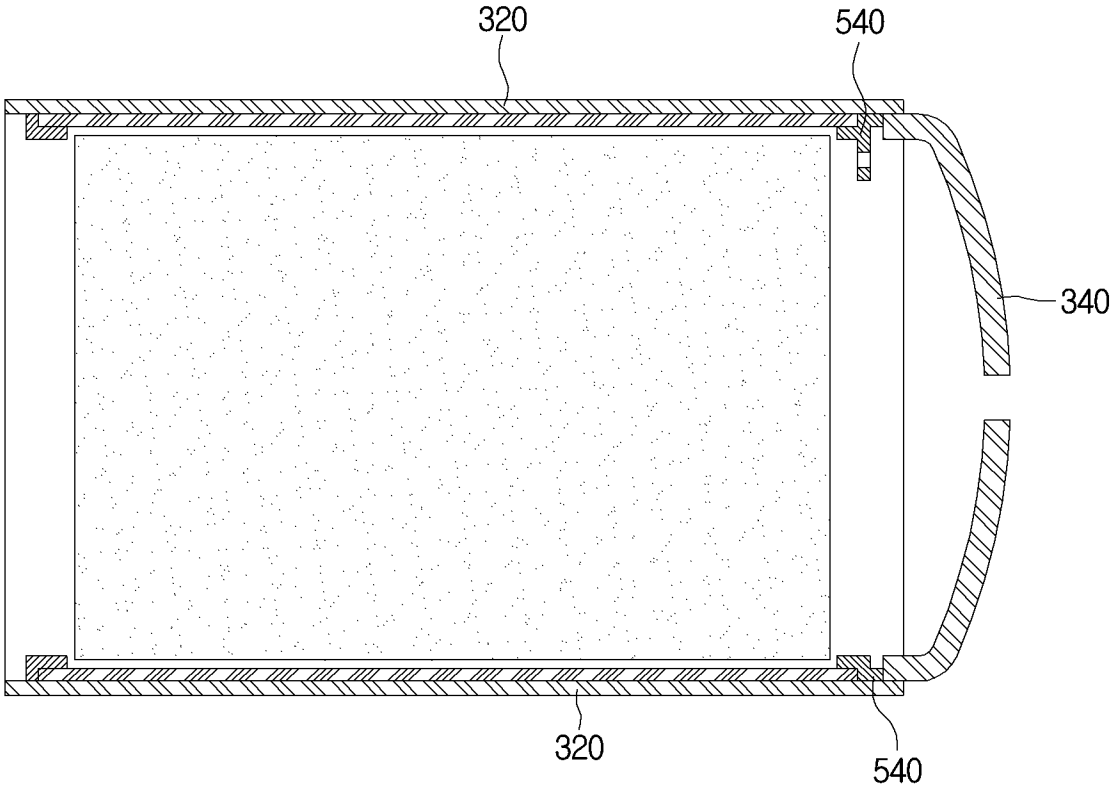

Referring to FIG. 16, the first cover 340 may be inserted into the first side of the base shell 320 onto or into which the first fixing member 540 is mounted. The first cover 340 may be mounted to contact the first fixing member 540.

Figure 17:
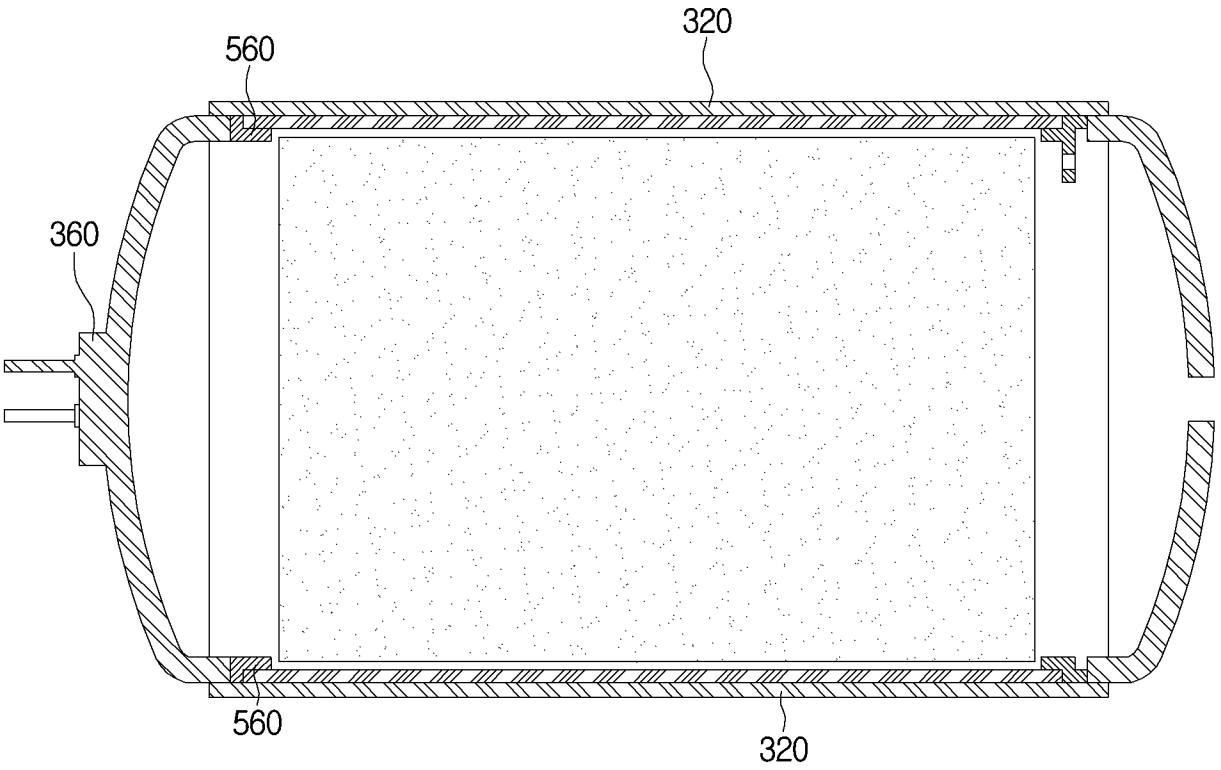

Referring to FIG. 17, the second cover 360 may be inserted into the second side of the base shell 320 onto or into which the second fixing member 560 is mounted. The second cover 360 may be mounted to contact the second fixing member 560. The first cover 340 and the second cover 360 may be mounted in reverse order.

Figure 18:
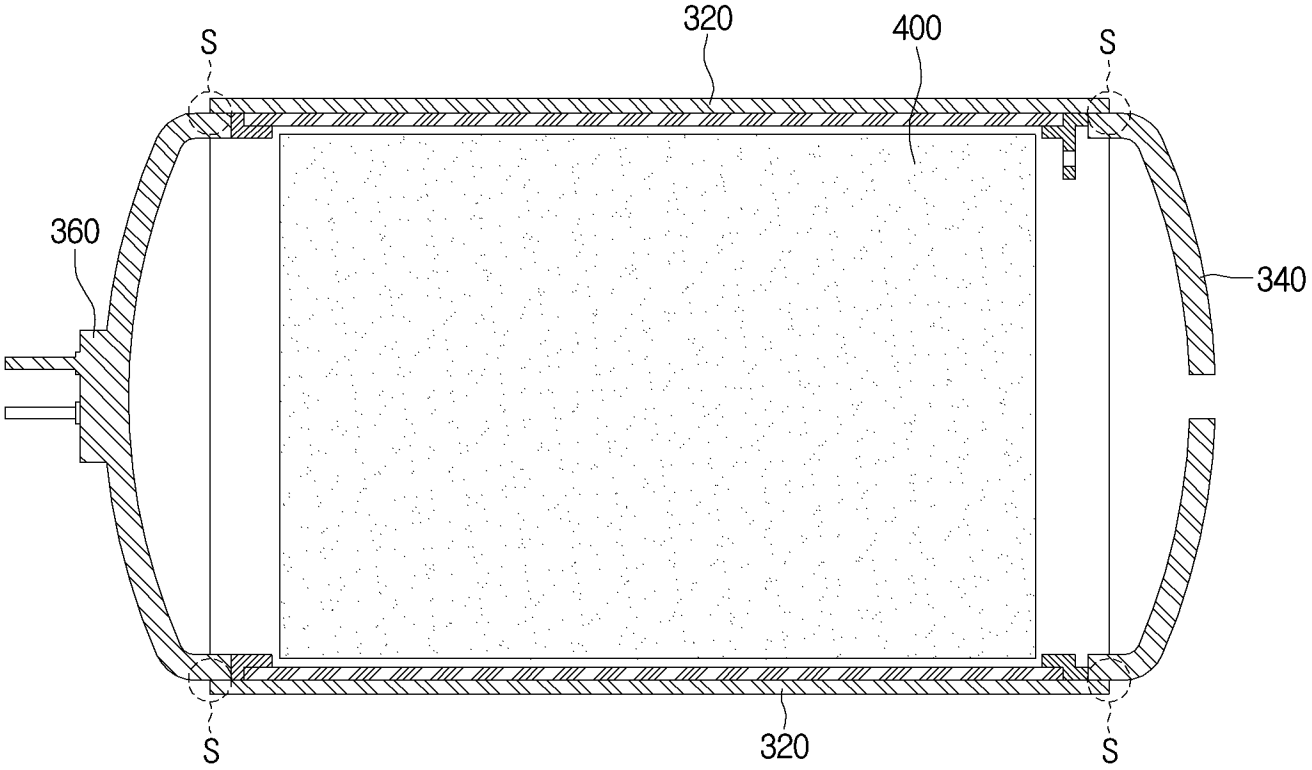

Referring to FIG. 18, each of the first and second covers 340 and 360 may be coupled to the base shell 320 by, for example, the welding process S. However, this, embodiment is not limited to the welding process S, that is, other processes to couple the first and second covers 340 and 360 to the base shell 320 may be applied. Thus, the compressor body 400 may be accommodated in the base shell 320.

Figure 19:
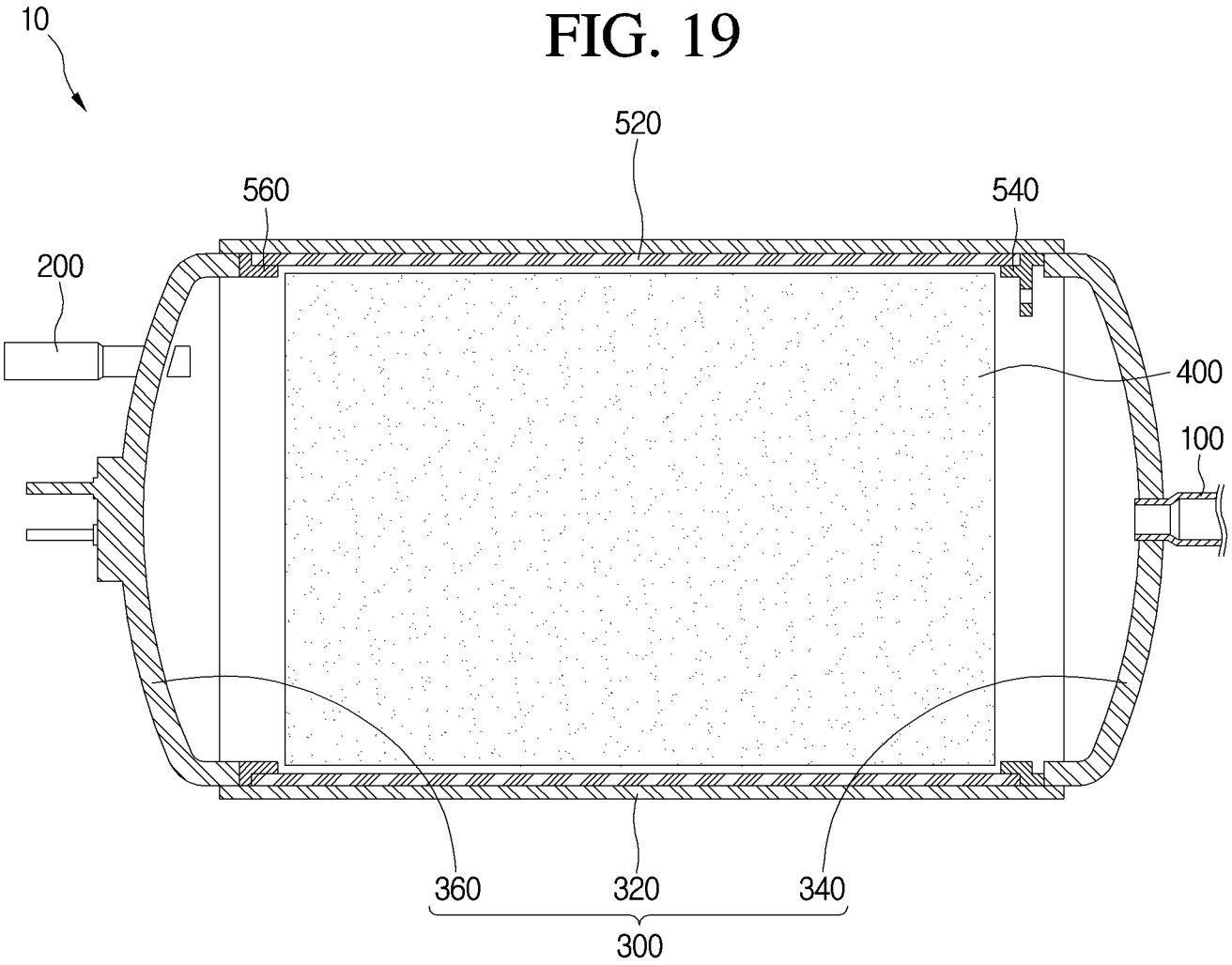

Referring to FIG. 19, the suction inlet 100 may be mounted on the first cover 340, and the discharge outlet 200 may be mounted on the second cover 360. Thus, the process of assembling the linear compressor 10 may be completed. Therefore, the refrigerant introduced from the suction inlet 100 may be compressed through the compressor body 400 and then discharged through the discharge outlet 200.

Through the above-described assembling process, in the linear compressor 10 according to this embodiment, the noise reducing member 520 having a simple structure may be mounted inside the compressor casing 300 to significantly reduce noise from the compressor casing 300, in particular, noise having middle to high frequency (1 kHz to 4 kHz) transmitted from the base shell 320.

Figure 20:
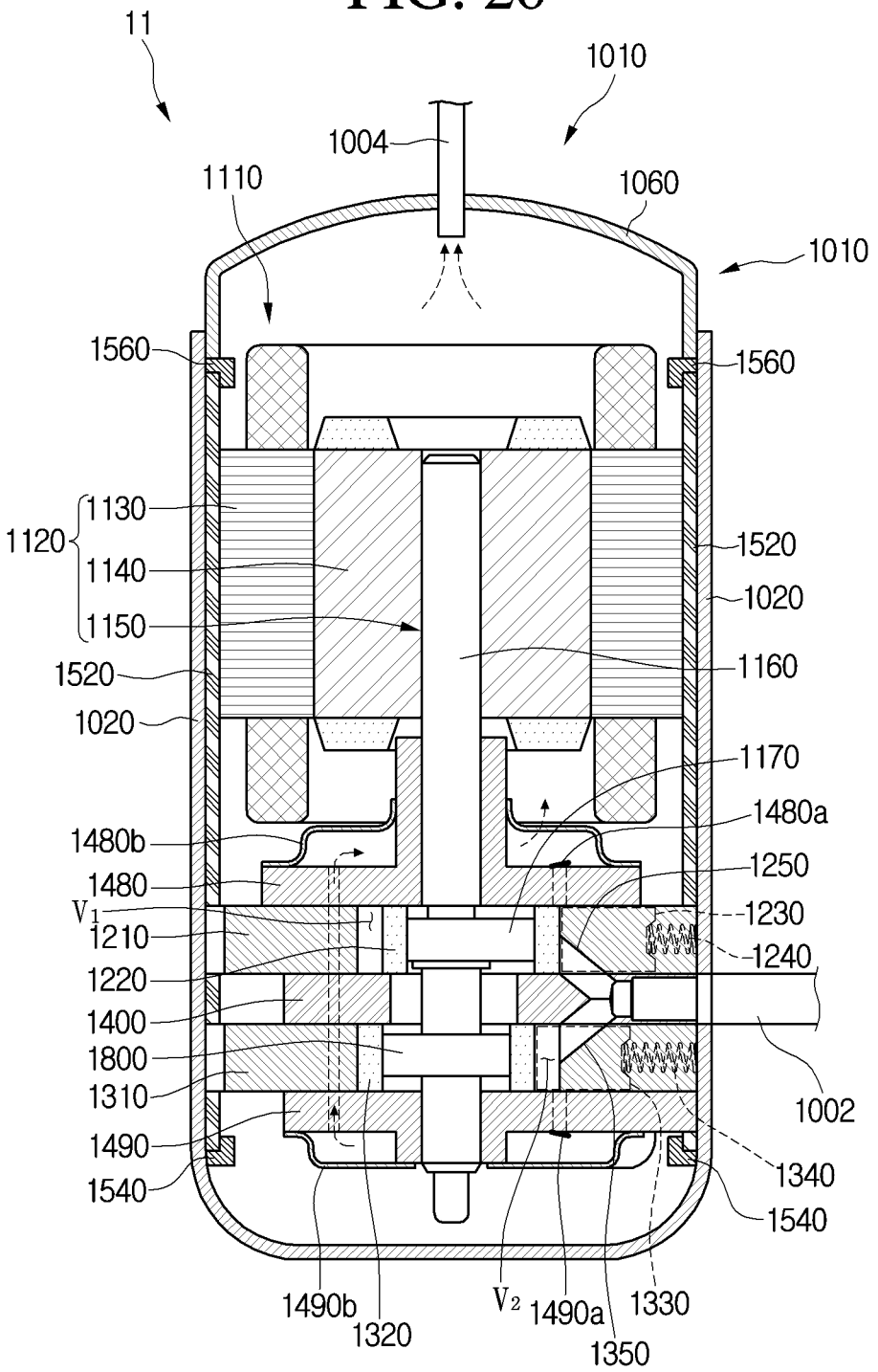
FIG. 20 is a cross-sectional view of a compressor according to another embodiment.

FIG. 20 is a cross-sectional view of a compressor according to another embodiment. Referring to FIG. 20, compressor 11 may be provided as a rotary compressor, in which a compression space, may be defined between a roller that eccentrically rotates and a cylinder to allow a working gas, such as a refrigerant, to be suctioned into and discharged from the compression space, and the working gas may be compressed while the roller is eccentrically rotated along an inner wall of the cylinder. The rotary compressor 11 may include a suction inlet 1002, a discharge outlet 1004, a compressor casing 1010, a compressor body 1110, a noise reducing member 1520, a first fixing member 1540, and a second fixing member 1560.

The suction inlet 1002 to introduce the refrigerant into the compressor casing 1010 may be mounted into the compressor casing 1010 to pass through a side surface of the compressor casing 1010. The discharge outlet 1004 to discharge the refrigerant out of the compressor casing 1010 may be mounted into the compressor casing 1010 to pass through an upper side of the compressor casing 1010.

The compressor casing 1010 may define an outer appearance of the rotary compressor 11. The compressor casing 1010 may include a base shell 1020, and a shell cover 1060.

The base shell 1020 may have a cylindrical shape. One side of the base shell 1020 may be open. Various components of the rotary compressor 11, such as the compressor body 1110, the noise reducing member 1520, the first fixing member 1540, and the second fixing member 1560, may be mounted on the base shell 1020. The suction inlet 1002 may pass through the base shell 1020.

The shell cover 1060 may cover the open side of the base shell 1020 to seal the base shell 1020. The discharge inlet 1004 may be mounted onto the shell cover 1060 to pass through the shell cover 1060.

The compressor body 1110 may include an electric mechanism 1120, a first compression device 1200, and a second compression device 1300. The electric mechanism 1120 may include a stator 1130 fixed to an inner circumferential surface of the base shell 1020, a rotor 1140 rotatably disposed in the stator 1130, and a rotational shaft 1150 which may be shrink-fitted into the rotor 1140, to rotate together with the rotor 1140. The electric mechanism 1120 may correspond to a constant motor or an inverter motor.

The rotational shaft 1150 may include a shaft 1160 coupled to the rotor 1140, a first eccentric portion 1170, and a second eccentric portion 1180 eccentrically disposed on a lower portion of the shaft portion 1160 in lateral directions, respectively.

The first eccentric portion 1170 and the second eccentric portion 1180 may be symmetrically disposed with a phase difference of about 180°. A first rolling piston 1220 and a second rolling piston 1320 may be rotatably coupled to the first and second eccentric portions 1170 and 1180, respectively.

The first compression device 1200 may include a first cylinder 1210 having a ring shape and disposed within the base shell 1020 to define a first compression space V1, the first rolling piston 1220 rotatably coupled to the first eccentric portion 1170 of the rotational shaft 1150 to compress refrigerant while orbiting in the first compression space V1, a first vane 1230 that contacts an outer circumferential surface of the first rolling piston 1220 and partitions the first compression space V1 of the first cylinder 1210 into a first suction chamber and a first discharge chamber, and a first vane spring 1240 to elastically support one side of the first vein 1230.

The second compression device 1300 may include a second cylinder 1310 having a ring shape and disposed under the first cylinder 1210 to define a second compression space V2, the second rolling piston 1320 rotatably coupled to the second eccentric portion 1180 of the rotational shaft 1150 to compress refrigerant while orbiting in the second compressing space V2, a second vane 1330 that contacts an outer circumferential surface of the second rolling piston 1320 and partitions the second compression space V2 of the second cylinder 310 into a second suction chamber and a second discharge chamber, and a second vane spring 1340 to elastically support one side of the second vein 1330.

A first cylinder suction portion 1250 to guide a refrigerant into the first compression space V1 may be disposed in the first cylinder 1210. A second cylinder suction portion 1350 to guide a refrigerant into the second compression space V2 may be disposed in the second cylinder 1310.

The compressor body 1110 may further include an upper bearing 1480 disposed on an upper portion of the first cylinder 1210, a lower bearing 1490 disposed on a lower portion of the second cylinder 1310, and an intermediate plate 1400 disposed between the first cylinder 1210 and the second cylinder 1310 to define the first and second compression spaces together with the upper and lower bearings 1480 and 1490. Each of the upper and lower bearings 1480 and 1490 may have a disk shape. A through hole may be defined in each of the upper and lower bearings 1490 to allow the rotational shaft 1150 to pass therethrough.

The compressor body 1110 may further include a first discharge valve 1480*a* disposed on the upper bearing 1480 to allow the refrigerant compressed in the first cylinder 1210 to be discharged, and a second discharge valve 1490*a* disposed on the lower bearing 1490 to allow the refrigerant compressed in the second cylinder 1310 to be discharged. The compressor body 1110 may also include a first discharge muffler 1480*b* disposed on the upper bearing 1480 to reduce noise generated by the refrigerant discharged through the first discharge valve 1480, and a second discharge muffler 1490*b* disposed below the lower bearing 1490 to reduce noise generated by the refrigerant discharged through the second discharge valve 1490*a*.

The noise reducing member 1520 may be mounted on the inner wall f the base shell 1020 so that the noise reducing member 1520 may be disposed between the base shell 1020 and the compressor body 1110. As the noise reducing member 1520 is similar to that of the previous embodiment, detailed description of the noise reducing member 1520 has been omitted.

The first and second fixing members 1540 and 1560 may be mounted inside the base shell 1020 so that the noise reducing member 1520 is fixed to the inner wall of the baser shell 1020. The first and second fixing members 1540 and 1560 may include a fixing portion and a protrusion similar to the previous embodiment. The first and second fixing members 1540 and 1560 may also be similar to the previous embodiment, and thus, repetitive descriptions of the first and second fixing members 1540 and 1560 have been omitted.

Similar to the previous embodiment, as the rotary compressor 11 according to this embodiment has the noise reducing member 1520 having a simple structure in the compressor casing 1010 to reduce noise generated when operating, noise from the compressor casing 1010, in particular, noise having middle to high frequency (1 kHz to 4 kHz) transmitted from the base shell 1020 may be significantly reduced.

Also, similar to the previous embodiment, the rotary compressor 11 according to this embodiment may stably mount the noise reducing member 1520 on the compressor casing 1010 using the first and second fixing members 1540 and 1560. Thus, the noise reducing member 1520 to reduce the noise generated from the compressor and the first and second fixing members 1540 and 1560 to mount the noise reducing member 1520 on the compressor casing 1010 according to this embodiment may be applied to the rotary compressor.

Figure 21:
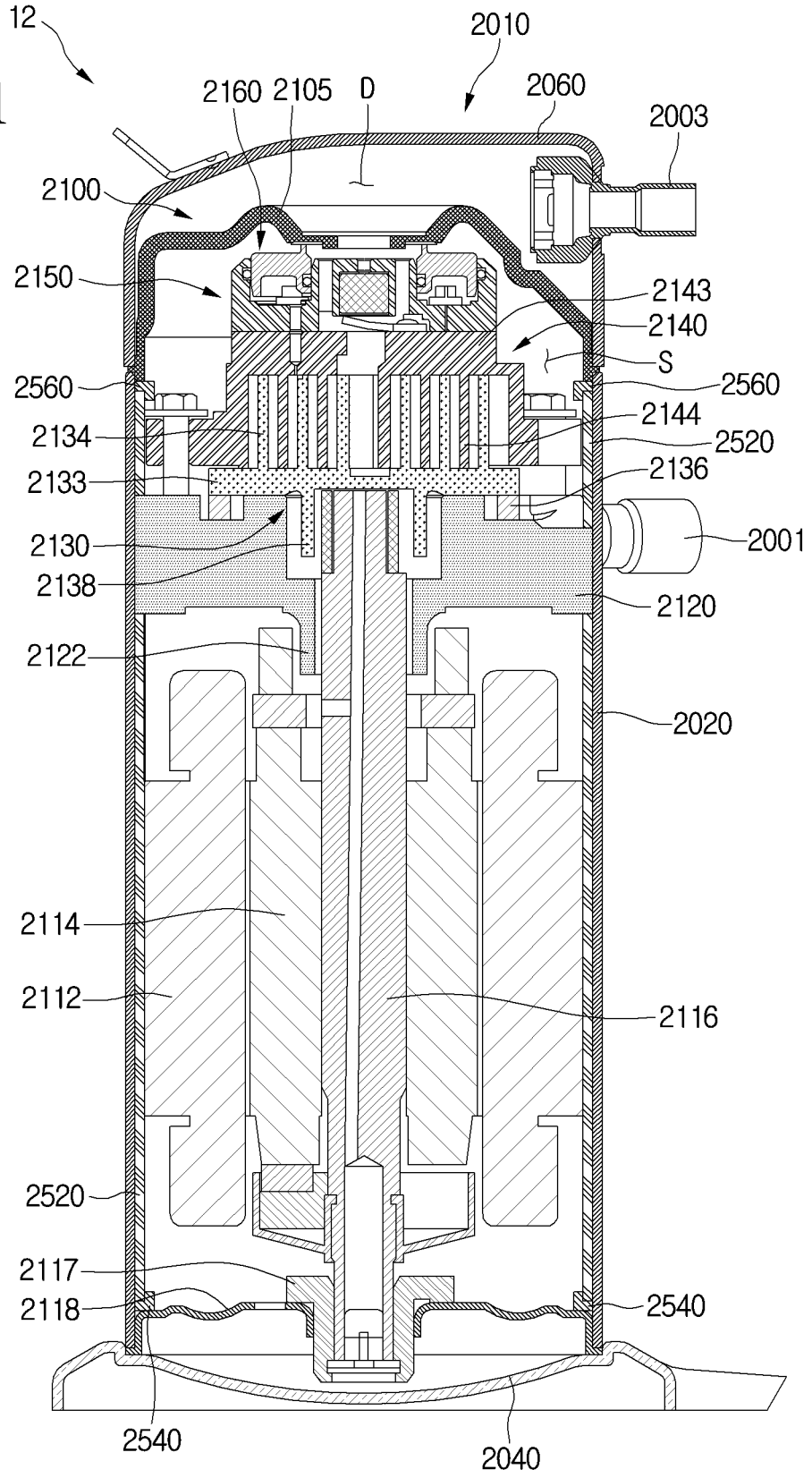
FIG. 21 is a cross-sectional view of compressor according to another embodiment.

FIG. 21 is a cross-sectional view of a compressor according to another embodiment. Referring to FIG. 21, compressor 12 may be provided as a scroll compressor, in which a compression space may be defined between an orbiting scroll and a fixed scroll, to allow a working gas, such as a refrigerant, to be suctioned into and discharged from the compression space, and the working gas compressed while the orbiting scroll rotates along the fixed, scroll. The scroll compressor 12 may include a suction inlet 2001, a discharge outlet 2003, a compressor casing 2010, a compressor body 2100, noise reducing member 2520, a first fixing member 2560, and a second fixing member 2540.

The suction inlet 2001 to introduce the refrigerant into the compressor casing 2010 may be mounted on the compressor casing 2010 to pass through one side surface of the compressor casing 2010. The discharge outlet 2003 to discharge the introduced refrigerant out of the compressor casing 2010 may be mounted on the compressor casing 2010 to pass through a top surface of the compressor casing 2010.

The compressor casing 2010 may include a base shell 2020, a first cover 2040, and a second cover 2060. The base shell 2020 may have an approximately cylindrical shape. The base shell 2020 may accommodate various components of the scroll compressor 12, such as the compressor body 2100 the noise reducing member 2520, the first fixing member 2540, and the second fixing member 2560. The suction inlet 2001 may be mounted on one side surface of the base shell 2020 to pass through the base shell 2020.

The first cover 2040 may be mounted on one, or at first side of the base shell 2010 to support the base shell 2020. The second cover 2060 may be mounted on the other or a second side of the base shell 2010 to cover the second side of the base shell 2020. The discharge outlet 2003 may be mounted on the second cover 2060 to pass through the second cover 2060.

The compressor body 2100 may include a discharge cover 2105, a motor assembly 2112, 2114, and 2116, an auxiliary bearing 2117, a lower frame 2118, a main frame 2120, an orbiting scroll 2130, a fixed scroll 2140, and a back pressure chamber assembly 2150 and 2160.

The discharge cover 2105 may be disposed under the second cover 2060 to partition an inner space of the compressor casing 2010 into a suction space S and a discharge space D. The suction space S may correspond to a lower side of the discharge cover 2105 and the discharge space D may correspond to an upper side of the discharge cover 2105.

The motor assembly 2112, 2114, and 2116 may be disposed under the suction space S. The motor assembly 2112, 2114, and 2116 may include a stator 2112, a rotor 2114, and a drive shaft 2116.

The stator 2112 may be coupled to an inner wall surface of the base shell 2020. The rotor 2114 may be rotatably disposed in the stator 2112. The drive shaft 2116 may be disposed to pass through a central portion of the rotor 2114.

The auxiliary bearing 2117 may be disposed in a lower portion of the base shell 2020 so that a lower side of the rotational shaft 2116 is rotatable. The lower frame 2118 may be coupled to the auxiliary bearing 2117 to stably support the rotational shaft 2116. The lower frame 2118 may be fixed to an inner wall of the base shell 2010.

The main frame 2120 may support an upper portion of the rotational shaft 2116 so that the rotational shaft 2116 is rotatable. The main frame 2120 may be fixed to the inner wall of the base shell 2010 similar to the lower frame 2118. A main bearing 2122 that protrudes downward may be formed on a bottom surface of the main frame 2120. The rotational shaft 2116 may be inserted into the main bearing 2122. The main bearing 2122 may have an inner wall that acts as a bearing surface to guide the rotational shaft 2116 to smoothly rotate.

The orbiting scroll 2130 may be disposed on an upper portion of the main frame 2120. The orbiting scroll 2130 may include a first end plate 2133 disposed on the main frame 2120 and having an approximately disc shape. The orbiting scroll 2130 may further include are orbiting wrap 2134 that extends from first end plate 2133 and having a spiral shape.

The first end plate 2133 may correspond to a main body of the orbiting scroll 2130 to define a lower portion of the orbiting scroll 2130. The orbiting wrap 2134 may extend from the first end plate 2133 to define an upper portion of the orbiting scroll 2130. The orbiting wrap 2134 and a fixed wrap 2144 of the fixed scroll 2140, which will be described hereinafter, may define a compression chamber.

The first end plate 2133 of the orbiting scroll 2130 may orbit in a state in which the first end plate 2133 is supported by a top surface of the main frame 2120. An Oldham ring 2136 may be disposed between the first end plate 2133 and the main frame 2120 to prevent the orbiting scroll 2130 from rotating. A boss 2138, into which an upper portion of the rotational shaft 2116 may be inserted, may be disposed on a bottom surface of the first end plate 2133 of the orbiting scroll 2130 to easily transmit a rotational force of the rotational shaft 2116 to the orbiting scroll 2130.

The fixed scroll 2140 may be disposed above the orbiting scroll 2130 and may be engaged with the orbiting scroll 2130. The fixed scroll 2140 may include a second end plate 2143 having a disc shape and the fixed wrap 2144, which may extend from the second end plate 2143 toward the first end plate 2133 and then be engaged with the orbiting wrap 2134 of the orbiting scroll 2130. The second end plate 2143 may correspond to a main body of the fixed scroll 2140 to define an upper portion of the fixed scroll 2140. The fixed wrap 2144 may extend downward from the second end plate 2143 to define a lower portion of the fixed scroll 2140. An end of the fixed wrap 2144 may contact the first end plate 2133, and an end of the orbiting wrap 2134 may contact the second end plate 2143.

The back pressure chamber assembly 2150 and 2160 may be disposed on the fixed scroll 2140. The back pressure chamber assembly 2150 and 2160 may be fixed to an upper portion of the second end plate 2143. The back pressure chamber assembly 2150 and 2160 may include a back pressure plate 2150, an a floating plate 2160 separably coupled to the back pressure plate 2150.

The noise reducing member 2520 may be mounted on the inner wall of the base shell 2020 so that the noise reducing member 2520 may be disposed between the base shell 2020 and the compressor body 2100. As the noise reducing member 2520 is similar to that of the previous embodiment, repetitive description of the noise reducing member 2520 has been omitted.

The first and second fixing members 2540 and 2560 may be mounted inside the base shell 2020 so that the noise reducing member 2520 may be fixed to the inner wall of the baser shell 2020. The first and second fixing members 2540 and 2560 may include a fixing portion and a protrusion similar to the previous embodiment. As first and second fixing members 2540 and 2560 are similar to those in the previous embodiment, repetitive descriptions of the first and second fixing members 2540 and 2560 have been omitted.

Similar to the previous embodiment, as the scroll compressor 12 according to this embodiment has the noise reducing member 2520 having a simple structure in the compressor casing 2010 to reduce noise generated when operating, noise from the compressor casing 2010, in particular, noise having middle to high frequency (1 kHz to 4 kHz) transmitted from the base shell 2020 may be significantly reduced.

Also, similar to as the previous embodiment, the scroll compressor 12 according this embodiment may stably mount the noise reducing member 2520 on the compressor casing 2010 using the first and second fixing members 2540 and 2560. In this way, the noise reducing member 2520 to reduce the noise generated from the compressor and the first and second fixing members 2540 and 2560 to mount the noise reducing member 2520 on the compressor casing 2010 according to this embodiment may be applied to the scroll compressor.

Embodiments disclosed herein provide a compressor capable of reducing, noise and a method of assembling a compressor.

Embodiments disclosed herein provide a compressor that may include a compressor casing coupled to each of a suction inlet, into which a refrigerant may be introduced, and a discharge outlet, through which the refrigerant may be discharged; a compressor body mounted inside the compressor casing to compress the refrigerant suctioned in through the suction inlet, and discharge the refrigerant through the discharge outlet; a noise reducing member disposed between the compressor body and the compressor casing; and at least one fixing member mounted inside the compressor casing to fix the noise reducing member to an inner wall of the compressor casing. A plurality of the fixing member may be provided and the noise reducing member may have both ends inserted into the fixing member and fixed to the inner wall of the compressor casing.

Each of the fixing members may include a fixing part or portion, one end or a first of which, may be fixed to the inner wall of the compressor casing, the fixing part having a ring shape, and a protrusion part or protrusion that extends from the other or a second end of the fixing part in a direction substantially perpendicular to a radial direction of the fixing part to allow the noise reducing member to be inserted. The plurality of fixing members may include a first fixing member that fixes one or a first end of the noise reducing member to the inner wall of the compressor casing and a second fixing member that fixes the other or a second end of the noise reducing member to the inner wall of the compressor casing.

The compressor body may include first and second plate springs, respectively, disposed on both ends thereof to allow the compressor body to be supported by the compressor casing. The first plate spring may be mounted on the first fixing member, and the second plate spring may be mounted on, the second fixing member.

Each of the fixing members may further include at least one spring mount part or mount that extends in a radial direction of the fixing part or the protrusion part. A plurality of the spring mount part may be provided, and the plurality of spring mount parts may be spaced a predetermined distance from each other along a circumferential direction of the fixing part or the protrusion part.

The compressor casing may include a base shell having a cylindrical shape to accommodate the compressor body; a first cover mounted on one or a first, side of the base shell, the first cover being coupled to the suction part, and a second cover mounted on the other or a second side of the base shell, the second cover being coupled to the discharge part. The noise reducing member may be mounted on an inner wall of the base shell. The noise reducing member may be mounted to surround the inner wall of the base shell.

The noise reducing member may have a cylindrical shape which may be rolled at least three times. The noise reducing member may include a plurality of cylindrical parts or portions, which may overlap each other, each of which may have a slit in a side surface thereof.

The first fixing member may be fixed to the base shell, and the noise reducing, member may have one or a first end inserted into the first fixing member. The second fixing member may be fixed to the base shell, and the noise reducing member may have the other or a second end inserted into the second fixing member. Each of the first and second fixing members may be fixed to the base shell through a press-fit process or a welding process for example. Each of the first and second covers may be coupled to the base shell through a welding process for example.

The compressor body may include a cylinder mounted along an axial direction of the compressor casing; a piston accommodated within the cylinder, the piston being reciprocated along the axial direction of the compressor casing; and a motor assembly that provides a drive force to allow the piston to be reciprocated. The compressor body may include a cylinder mounted along an axial direction of the compressor casing; a rolling piston that eccentrically rotates within the cylinder; and a motor assembly that provides a drive force to allow the rolling piston to eccentrically rotate. The compressor body may include a fixed scroll mounted along an axial direction of the compressor casing, the fixed scroll having a spiral wrap; an orbiting scroll orbiting with respect to the fixed scroll; and a motor assembly that provides a drive force to allow the orbiting scroll to orbit.

Embodiments disclosed herein further provide a method of assembling a compressor that may include a compressor body, in which a refrigerant suctioned in through a suction inlet may be compressed and discharged to a discharge outlet. The method may include mounting one fixing member on one side of an inner wall of a base shell having a cylindrical shape to accommodate the compressor body; inserting one or a first end of a noise reducing member into the fixing member; inserting the compressor body into the base shell to mount the compressor body inside the noise reducing member; mounting the other fixing member on the other or a second side of the inner wall of the base shell so that the other end of the noise reducing member is inserted; mounting a first cover coupled to the suction part on one or a first side of the base shell; and mounting a second cover coupled to the discharge part on the other or a second side of the base shell.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure the drawings and the appended claims. In addition to variations and modifications in the component parts and/or arrangements, alternative uses will also be apparent to those skilled in the art.

What is claimed is:

1. A compressor, comprising:

a compressor casing coupled to each of a suction inlet, into which a refrigerant is introduced, and a discharge outlet, through which the refrigerant is discharged;

a compressor body mounted inside the compressor casing to compress the refrigerant suctioned in through the suction inlet, and thereafter discharge the refrigerant through the discharge outlet;

a noise reducing member disposed between the compressor body and the compressor casing;

first and second fixing members mounted inside the compressor casing to fix both ends of the noise reducing member to an inner wall of the compressor casing, wherein the both ends of the noise reducing member are respectively inserted into the first and second fixing members; and first and second plate springs, respectively, disposed at first and second lateral ends of the compressor body to allow the compressor body to be supported by the compressor casing, and wherein the first plate spring is mounted on the first fixing member, and the second plate spring is mounted on the second fixing member, wherein each of the first and second fixing members comprises:

a fixing portion fixed to the inner wall of the compressor casing, the fixing portion having a ring shape, and a protrusion that extends from the fixing portion in a direction substantially perpendicular to a radial direction of the fixing portion.

2. The compressor according to claim 1, wherein each of the first and second fixing members further comprises:

a plurality of spring mounts that extends in a radial direction of the respective fixing portion or the protrusion, wherein the plurality of spring mounts is spaced a predetermined distance from each other along a circumferential direction of the fixing portion or the protrusion.

3. The compressor according to claim 1, wherein the compressor casing comprises:

a base shell having a cylindrical shape to accommodate the compressor body;

a first cover mounted at a first lateral end of the base shell, the first cover being coupled to the suction inlet; and a second cover mounted at a second lateral end of the base shell, the second cover being coupled to the discharge outlet, wherein the noise reducing member is mounted on an inner wall of the base shell.

4. The compressor according to claim 3, wherein the noise reducing member surrounds the inner wall of the base shell.

5. The compressor according to claim 4, wherein the noise reducing member has a cylindrical shape, which is rolled at least three times.

6. The compressor according to claim 4, wherein the noise reducing member comprises a plurality of cylindrical portions, which overlap each other, each of which has a slit in a side surface thereof.

7. The compressor according to claim 3, wherein the first fixing member is fixed to the base shell, wherein the first lateral end of the noise reducing member is inserted into the first fixing member, wherein the second fixing member is fixed to the base shell, and wherein the second lateral end of the noise reducing member is inserted in to the second fixing member.

8. The compressor according to claim 7, wherein each of the first and second fixing members is fixed to the base shell by a press-fit or welding.

9. The compressor according to claim 3, wherein each of the first and second covers is coupled to the base shell by welding.

10. The compressor according to claim 1, wherein the compressor body comprises:

a cylinder mounted along an axial direction of the compressor casing;

a piston accommodated within the cylinder, the piston being reciprocated along the as direction of the compressor casing; and a motor that provides a drive force to reciprocate the piston.

* * * * *